US006212352B1

(12) United States Patent
Kagawa et al.

(10) Patent No.: US 6,212,352 B1
(45) Date of Patent: Apr. 3, 2001

(54) COLOR IMAGE FORMING APPARATUS SPACIALLY SEPARATING TONER IMAGE HEAT-FUSION FROM TONER IMAGE TRANSFER TO A RECORDING MEDIUM

(75) Inventors: Toshiaki Kagawa, Sakurai; Taisuke Kamimura, Kitakatsuragi-gun, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/217,535

(22) Filed: Dec. 21, 1998

(30) Foreign Application Priority Data

Dec. 26, 1997 (JP) ..... 9-361199

(51) Int. Cl.[7] ..... G03G 15/16; G03G 15/20
(52) U.S. Cl. ..... 399/307
(58) Field of Search ..... 399/298, 302, 399/307, 308

(56) References Cited

U.S. PATENT DOCUMENTS 3,957,367 * 5/1976 Goel ..... 399/302
4,453,820 * 6/1984 Suzuki ..... 399/308
4,992,833 * 2/1991 Derimiggio ..... 399/308
5,233,397 * 8/1993 Till ..... 399/307
5,493,373 * 2/1996 Gunlach et al. ..... 399/302

FOREIGN PATENT DOCUMENTS 8-44220 2/1996 (JP) .
9-114282 5/1997 (JP) .

* cited by examiner

*Primary Examiner*—William J. Royer
(74) *Attorney, Agent, or Firm*—Dike, Bronstein, Roberts & Cushman, LLP; David G. Conlin; David A. Tucker

(57) ABSTRACT

A color image forming apparatus fixes a superimposed multi-color toner image, heat-fused at a heating section of an intermediate transfer belt, onto a recording material at a fixing nip section at which a pressing roller presses against the intermediate transfer belt. The fixing nip section is provided at the downstream end of the heating section in a turning direction of the intermediate transfer belt. The present apparatus can accelerate a fixing rate while maintaining stable fixing properties for a multi-layer toner image of a color image having different layer thicknesses with any kind of recording papers under any operation condition, and requires a shorter warm-up period while attaining excellent heat efficiency.

13 Claims, 11 Drawing Sheets

COLOR IMAGE FORMING APPARATUS SPACIALLY SEPARATING TONER IMAGE HEAT-FUSION FROM TONER IMAGE TRANSFER TO A RECORDING MEDIUM

FIELD OF THE INVENTION

The present invention relates to a color image forming apparatus using an electrophotographic process, such as a copying machine, a facsimile machine, and a printer.

BACKGROUND OF THE INVENTION

Conventionally, a typical color image forming apparatus using an electrophotographic process, such as a copying machine, a facsimile, and a printer, forms a toner image on the surface of a photosensitive body, then transfers the same onto a recording sheet while feeding the recording sheet to a fuser, and fuses the toner image onto the recording sheet, thereby turning the toner image into a permanent image.

Recently, an image forming apparatus of a different type has been put in practical use. To be more specific, this type of color image forming apparatus tranfers a toner image formed on the photosensitive body onto an intermediate transfer belt, then heats the toner image thereon, and fixes the toner image onto a recording sheet upon transfer. Examples of the image forming apparatus of this type are disclosed in Japanese Laid-open Patent Application No. 44220/1996 (Tokukaihei No. 8-44220) (which is referred to as prior art A, hereinafter), and Japanese Laid-open Patent Application No. 114282/1997 (Tokukaihei No. 9-114282) (which is referred to as prior art B, hereinafter), for example.

The image forming apparatus of prior art A is mainly arranged to form a color image. As shown in FIG. 10, this image forming apparatus includes a photosensitive body 84, and toner images T of respective colors developed on the surface of the photosensitive body 84 are transferred and superimposed successively on an intermediate transfer belt 80 by means of a transfer roller 81 which also serves as a driving roller.

The intermediate transfer belt 80 is bridged across the transfer roller 81, a sub-roller 82 also serving as a belt tension roller, and a thermal heater 83. A pressing roller 85 is provided to oppose the thermal heater 83 through the intermediate transfer belt 80. The pressing roller 85 either keeps a space from or touches the intermediate transfer belt 80 as the case may be.

To be more specific, the pressing roller 85 keeps a space from the intermediate transfer belt 80 while the toner images of respective colors are being transferred thereon, and touches the same when the above toner image transferring step is completed.

A recording paper P is transported to a pressing section (fixing nip section) Y of the pressing roller 85 against the thermal heater 83, and a superimposed multi-color toner image T' is fixed onto the recording paper P upon transfer by the heat conveyed from the thermal heater 83 and the pressure applied by the pressing roller 85.

Also, as shown in FIG. 11, the image forming apparatus of prior art B includes an intermediate transfer belt 95 bridged across supporting rollers 92 and 93 in such a manner to oppose a photosensitive belt 91.

In this image forming apparatus, a toner image T is formed on the photosensitive belt 91 and subsequently transferred onto the intermediate transfer belt 95. Then, a transferred toner image T' on the intermediate transfer belt 95 is heat-fused by a heating roller 96 touching an outer circumferential surface of the intermediate transfer belt 95 and having a halogen lamp serving as a heat source 96*a* inside, after which the toner image T' is fixed onto a recording material P upon transfer at a pressing section (fixing nip section ) Y of a pressing roller 97 against the supporting roller 93, both provided at the downstream end of the heating roller 96.

In this image forming apparatus, the toner alone is heat-fused in a satisfactory manner by heating the toner and intermediate transfer belt 95 having a small heat capacity before fixing the toner image onto the recording material P. Thus, the recording material P does not have to be heated, thereby attaining an effect that fixing energy is reduced to one third.

However, the image forming apparatus of prior art A has the following problems.

1) To attain satisfactory fixing strength, a temperature at the interface between the toner and recording paper P must be raised quite high. Particularly, in case of a color image, a multi-layer toner image in multiple colors must be heated at the fixing nip section for a considerable time to convey the heat to the interface between the toner and recording paper P, thereby imposing a limit on the acceleration of a fixing rate.

2) Since a color image is composed of multi-layer toner image portions and single-layer image portions having their respective layer thicknesses, if the entire color image is heated to attain a satisfactory fixing strength at the multi-layer toner image portions, the single-layer toner image portions are heated too much, thereby causing a so-called high-temperature offset. Conversely, if the entire color image is heated to attain a satisfactory fixing strength at the single-layer toner image portions, the multi-layer toner image portions are not heated satisfactorily, thereby causing fixing deficiency.

Also, the image forming apparatus of prior art B has the following problems.

3) Even if the toner is heat-fused in a satisfactory manner before the toner image is fixed onto the recording material P upon transfer, satisfactory fixing strength may not be attained if the recording material P is too cold. This happens because the toner is cooled and turned into solid as it confers its heat to the recording material P before it impregnates into microscopic spaces among the fibers of which the recording material P is made. To eliminate this inconvenience and constantly attain satisfactory fixing strength, the recording material P must be pre-heated or the toner and intermediate transfer belt 95 must be heated exceedingly to raise temperatures thereof well above a fixing temperature of the toner (for example, up to 170° C. when a fixing temperature of the toner is 102° C.), so that a temperature of the recording material P is also raised sufficiently high at the fixing nip section Y. Thus, in case of a single-layer toner image for a monochrome image, such heating requires more or less the same fixing energy as in the conventional method.

4) The toner and intermediate transfer belt 95 heated by the heating roller 96 touch the supporting roller 93 before they are pressed against the recording material P. Thus, if the supporting roller 93 is not heated as high as the toner and intermediate transfer belt 95, the toner and intermediate transfer belt 95 conveys the heat to the supporting roller 93, and the toner is cooled and turned into solid before it is fixed onto the recording material P upon transfer. This problem may be solved by heating the supporting roller 93 sufficiently, but a warm-up period is undesirably extended in turn.

Further, prior arts A and B share the following problem.

5) Since the toner fixing properties depend not only on the temperatures of the thermal heater and heating roller, but also on the temperature of the pressing roller, the fixing properties readily vary right after the warm-up and with operation conditions, such as continuous feeding. The fixing properties also vary with the kinds of the recording paper P (recording material P) (normal papers, envelopes, postcards, OHPs, labels, etc.) or thickness (basis weight) thereof.

SUMMARY OF THE INVENTION

It is therefore an object of the present invention to provide a color image forming apparatus which can accelerate a fixing rate while maintaining stable fixing properties for a multi-layer toner image of a color image having different layer thicknesses with any kind of recording papers under any operation condition, and requires a shorter warm-up period while attaining excellent heat efficiency.

To fulfill the above and other objects, a color image forming apparatus of the present invention is furnished with:

an image carrying body supported in such a manner that a toner image forming surface thereof is allowed to circulate;

an image forming section for forming a multi-color toner image on the image carrying body by sequentially superimposing toner images in respective colors;

a heating section for heat-fusing the multi-color toner image; and a pressing section for pressing against the image carrying body from the toner image forming surface side, wherein:

the multi-color toner image heat-fused is fixed onto a recording material upon transfer at a pressing position of the pressing section against the image carrying body; and the pressing position of the pressing section against the image carrying body is spaced apart from a heating position where the multi-color toner image is heated by the heating section.

According to the above arrangement, since a position where the toner image is heated is spaced apart from a position where the toner is fixed onto the recording material upon transfer, the pressing position of the pressing section against the image carrying body can be set to keep a space from the above heating position, for example, at the downstream end of the heating position along a circulation direction of the image carrying body.

Consequently, a long portion can be used to heat the toner image along the circulation direction regardless of the pressing position, thereby making it possible to extensively heat the toner image formed on the image carrying body. For this reason, even a multi-layer toner image in multiple colors can be fused uniformly in a shorter time regardless of the layer thickness.

Thus, a multi-layer toner image in multiple colors can be fixed more rapidly. Also, even when the layer thickness of the multi-layer toner image varies, uniform and stable fixing properties can be attained.

For a fuller understanding of the nature and advantages of the invention, reference should be made to the ensuing detailed description taken in conjunction with the accompanying drawings.

DESCRIPTION OF THE EMBODIMENTS

Referring to the accompanying drawings, the following description will describe example embodiments of the present invention.

Embodiment 1

Referring to FIGS. 1 through 7, the following description will describe an example embodiment of the present invention. In the present embodiment, a color laser printer is explained as an example color image forming apparatus of the present invention.

To begin with, a color laser printer of the present embodiment will be explained briefly.

Figure 1:
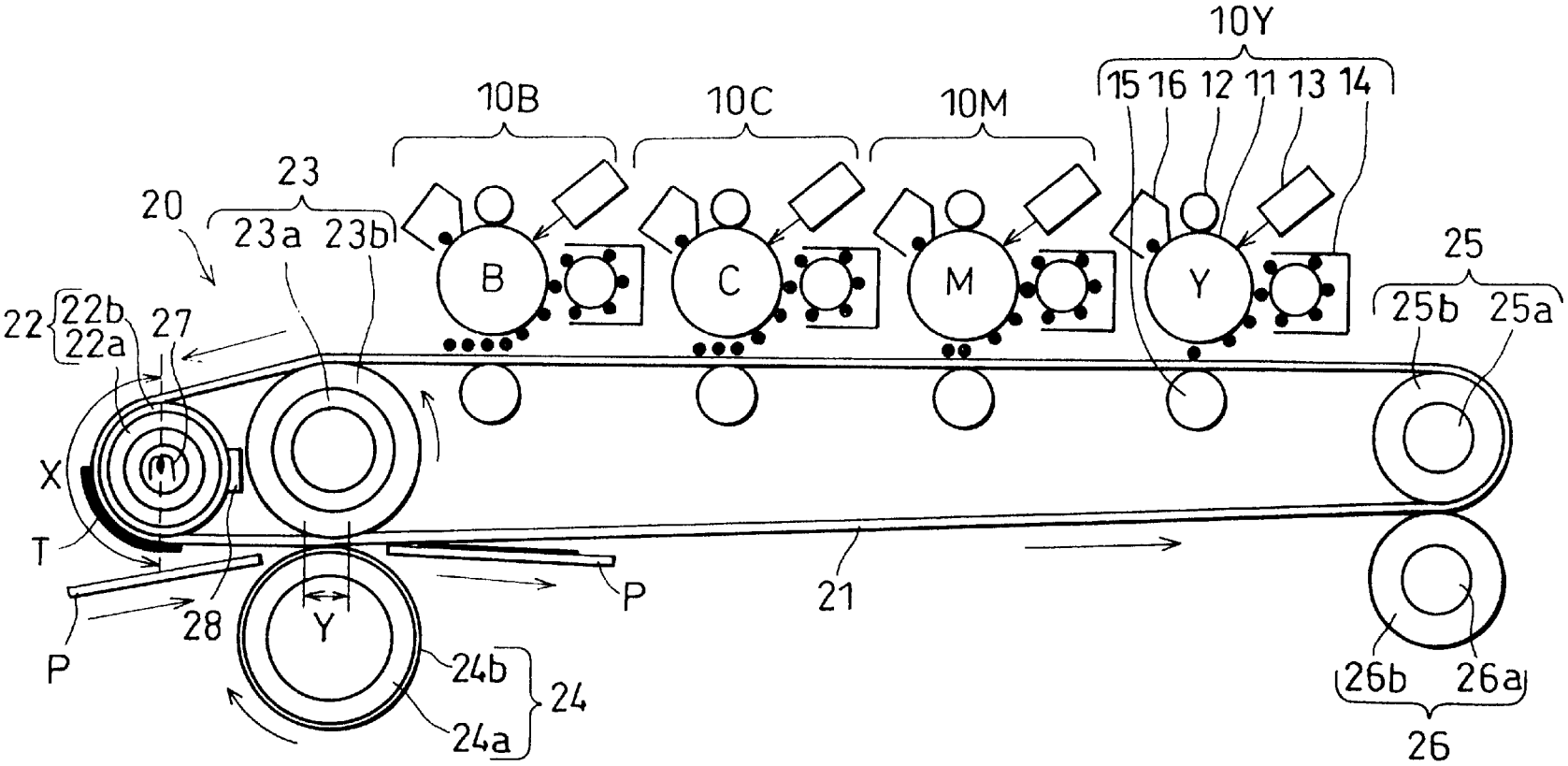
FIG. 1 is a view schematically showing an arrangement of a color laser printer in accordance with an example embodiment of the present invention.

As shown in FIG. 1, the color laser printer includes four visible image forming units 10Y, 10M, 10C, and 10B as image forming means, and a transfer/fixing unit 20.

The transfer/fixing unit 20 includes an intermediate transfer belt 21 as an image carrying belt, a heating roller 22 as heating means, a fixing roller 23, a pressing roller 24, a tension roller 25, and a cleaning roller 26, all of which are allowed to turn or rotate while their axes of rotation being aligned parallel to each other.

The intermediate transfer belt 21 is an image carrying body, bridged across the heating roller 22 and tension roller 25, for carrying toner images formed by each of the four visible image forming units 10Y, 10M, 10C, and 10B. The fixing roller 23 and pressing roller 24 are provided at the downstream end of the heating roller 22 along the turning direction of the intermediate transfer belt 21 as a pair of rollers opposing each other through the intermediate transfer belt 21. The pressing roller 24 is pressed against the fixing roller 23 at a predetermined pressure by unillustrated pressing means.

The cleaning roller 26 is provided at the downstream end of the fixing roller 23 and pressing roller 24 along the turning direction of the intermediate transfer belt 21 in such a manner to oppose the tension roller 25 through the intermediate transfer belt 21. The cleaning roller 26 is pressed against the tension roller 25 at a predetermined pressure by an unillustrated pressing device.

The aforementioned four visible image forming units 10Y, 10M, 10C and 10B are provided sequentially at the downstream end of the cleaning roller 26 along the turning direction of the intermediate transfer belt 21 in such a manner to oppose the outer circumferential surface of the intermediate transfer belt 21.

Each visible image forming unit includes a photosensitive drum 11 surrounded by a charging roller 12, laser beam irradiating means 13, a developer 14, a transfer roller 15, and a cleaner 16. In FIG. 1, the aforementioned components are labeled with their respective numerical references for the visible image forming unit 10Y alone and the numerical references are omitted for the rest for the explanation's convenience.

The developer 14 in each visible image forming unit withholds a different color. To be more specific, yellow (Y) toner is withheld in the developer 14 of the visible image forming unit 10Y, and likewise, magenta (M) toner in the developer 14 of the visible image forming unit 10M, cyan (C) toner in the developer 14 of the visible image forming unit 10C, and black (B) toner in the developer 14 of the visible image forming unit 10B.

Each visible image forming unit transfers the toner image sequentially to the intermediate transfer belt 21 in the following manner.

That is, the surface of the photosensitive drum 11 is electrically charged uniformly by the charging roller 12, and exposed by a laser beam emitted from the laser beam irradiating means 13 in accordance with image information, whereby an electrostatic latent image is formed thereon. Later, the electrostatic latent image on the photosensitive drum 11 is developed to a toner image by the developer 14 in each of the visible image forming units 10Y, 10M, 10C, and 10B. Each visible toner image is transferred onto the intermediate transfer belt 21 in the transfer/fixing unit 20 sequentially by the transfer roller 15, to which a bias voltage of a polarity opposite to the polarity of the toner is applied.

Next, the transfer/fixing unit 20 will be explained in detail.

The intermediate transfer belt 21 used in the present embodiment is a 80 mm-long and 40 $\mu$m-thick endless belt made of metallic nickel produced by means of electrocasting whose outer circumferential surface is coated with a 150 $\mu$m-thick releasing layer made of silicone rubber. Note that the arrangement of the intermediate transfer belt 21 is not limited to the above disclosure, and for example, it may be a 30 $\mu$m-thick polyimide belt whose outer circumferential surface is coated with a 150 $\mu$m-thick releasing layer made of silicone rubber.

The heating roller 22 is composed of an aluminum drum 22*a* having a diameter of 15 mm and a thickness of 0.5 mm and coated with a 20 $\mu$m-thick coating layer 22*b* made of fluoride rubber. A halogen lamp (heater lamp) 27 of 800 W is provided inside the heating roller 22 as a heat source for heating the surface thereof.

The coating layer 22*b* is provided to secure a driving force for the intermediate transfer belt 21. For this reason, the coating layer 22*b* is made as thin as possible so as not to deteriorate the heating properties of the heating roller 22 with respect to the intermediate transfer belt 21. In addition, a metallic filler is attached to the coating layer 22*b* to improve heat conductivity.

As shown in FIG. 1, the intermediate transfer belt 21 is wound around the heating roller 22 at a contact angle of about 180 degrees, whereby a heating section X (heating length of 23.5 mm, for example) for heat-fusing the toner image T transferred onto the intermediate transfer belt 21 is formed at the inner circumferential surface of the intermediate transfer belt 21.

A thermistor 28 is provided to touch the heating roller 22 at an outer circumferential portion other than the heating section X. Thus, a surface temperature of the heating roller 22 is detected and the ON/OFF state of the halogen lamp 27 is controlled based on the detected surface temperature, thereby allowing the surface temperature to remain at a predetermined level (herein, 170° C.). Here, the warm-up requires substantially no waiting time, because it only takes 10 or less seconds to raise the surface temperature of the heating roller 22 to 170° C. since the halogen lamp 27 is switched ON.

The fixing roller 23 is provided on the side of the inner circumferential surface of the intermediate transfer belt 21, and composed of an aluminum column 23*a* having a diameter of 20 mm and coated with a 5 mm-thick heat-resistant elastic layer 23*b* made of silicone rubber.

The pressing roller 24 is composed of an aluminum drum 24*a* having a diameter of 30 mm and a thickness of 5 mm and coated with a 10 $\mu$m-thick releasing layer 24*b* made of fluoride resin (polytetrafluoroethylene or PTFE for short). Note that the drum 24*a* is not necessarily made of aluminum, and high heat conducting materials, such as carbon steel, can be used as the case needed.

In addition, the pressing roller 24 is provided on the outer circumferential surface of the intermediate transfer belt 21 at a position opposing the fixing roller 23. Here, the pressing roller 24 and fixing roller 23 form a pair of rollers serving as pressing means. The pressing roller 24 is pressed against the fixing roller 23 at a predetermined pressure (herein, 180 N) by an unillustrated pressing device through the intermediate transfer belt 21, whereby a fixing nip section Y is formed.

Herein, a width of the fixing nip section Y (fixing nip width) is set to 4.5 mm. Also, since the fixing nip section Y is composed of two rollers: the soft elastic fixing roller 23 and a hard (metal) pressing roller 24, a cross section of the fixing nip section Y forms a convex shape curving upward. Thus, the recording paper P transported to the fixing nip section Y is readily separated from the intermediate transfer belt 21 even if a separating claw is not provided therein.

As has been explained, in the above-arranged color laser printer, the length of the heating section X (heating length) is set to 23.5 mm, and the length of the fixing nip section Y (fixing nip length) formed at the downstream end of the heating section X is set to 4.5 mm, while the heating section X is spaced apart from the fixing nip section Y serving as the fixing section where the toner image is fixed onto the recording paper P upon transfer. The above lengths are located at intervals along the turning direction of the intermediate transfer belt 21. Therefore, a heating length far longer than the length of the fixing nip section Y can be readily provided. Hence, if a turning rate of the intermediate transfer belt 21 is increased, the toner image on the intermediate transfer belt 21 can be fused in a reliable manner. Thus, compared with conventional image forming apparatus which heat-fuses the toner upon fixing onto the recording paper, a higher processing rate can be attained.

Here, let $L_1$ be a length of the heating section X and $L_2$ be a length of the fixing nip section Y, then $2L_2<L_1<10L_2$, and preferably, $3L_2<L_1<8L_2$, and more preferably, $4L_2<L_1<6L_2$.

Next, heat capacities of the intermediate transfer belt 21 and pressing roller 24 will be explained.

A heat capacity Cb of the intermediate transfer belt 21 per unit area is computed as follows:

Given that:

a specific heat of Ni electrocasting section: 0.439 J/g° C.

a specific gravity of Ni electrocasting section: 8.9 g/cm$^3$ a specific heat of silicone rubber: 1.09 J/g° C.

a specific gravity of silicone rubber: 1.05 g/cm$^3$ then, $$Cb=(0.439\times8.9\times0.004)+(1.09\times1.05\times0.015)=0.0327\ \text{J/° C.}$$

On the other hand, a heat capacity Cr of the pressing roller 24 per unit area can be found as follows:

Given that:

a specific heat of aluminum: 0.9 J/g° C.

a specific gravity of aluminum; 2.7 g/cm$^3$ a specific heat of PTFE: 1.05 J/g° C.

a specific gravity of PTFE: 2.14 g/cm$^3$ then, $$Cr=[0.9\times2.7\times(1.5^2-1^2)\pi+1.05\times2.14\times(1.501^2-1.5^2)\pi]/3\pi)=1.01\ \text{J/° C.}$$

In other words, the heat capacity Cr of the pressing roller 24 is set to a value more than 30 times of the heat capacity Cb of the intermediate transfer belt 21. In short, it is set as $Cr \gg Cb$ ($Cr>30\times Cb$). Although it will be described below, this arrangement is provided to minimize a rise in temperature of the pressing roller 24 by the heat transmitted from the intermediate transfer belt 21.

Further, the aforementioned heating roller 22, fixing roller 23, and pressing roller 24 are aligned with respect to each other in such a manner that the intermediate transfer belt 21 goes into the fixing nip section Y along a tangential line direction. For example, the heating section X is positioned at the inner circumference surface of the intermediate transfer belt 21. This arrangement makes it possible to prevent a drop in temperatures of the toner image T and intermediate transfer belt 21 heated by the heating roller 22, which happens when they touch the fixing roller 23 too long at the upstream end of the fixing nip section Y along the turning direction of the intermediate transfer belt 21.

The tension roller 25 is composed of an aluminum column 25*a* having a diameter of 16 mm and coated with a coating layer 25*b* made of silicone rubber. The tension roller 25 exerts predetermined tension so that the intermediate transfer belt 21 is not bent.

The cleaning roller 26 is composed of an aluminum column 26*a* having a diameter of 16 mm with a 2 mm-thick felt 26*b* made of Nomex of Dupont being wound around in spiral.

Next, the operation of the above-arranged color laser printer will be explained in the following.

To begin with, the halogen lamp 27 provided inside the heating roller 22 is switched ON while the intermediate transfer belt 21 is kept stopped, whereby a temperature on the surface of the heating roller 22 is raised to a predetermined level (herein, 170°). The intermediate transfer belt 21 is kept stopped during the warm-up period for the two following reasons:

1) to prevent a delay in the rise of the temperature of the surface of the heating roller 22 that otherwise would result from a transfer of heat away from the surface of heating roller 22 when intermediate transfer belt 21 was moving; and 2) to prevent an increase in temperature of the pressing roller 24 by the heat transmitted from the heated intermediate transfer belt 21.

Then, when the warm-up of the heating roller 22 is completed, the heating roller 22, fixing roller 23, and pressing roller 24 are driven to rotate, so as to turn the intermediate transfer belt 21 and sequentially transfer and superimpose the toner images formed by the visible image forming units 10Y, 10M, 10C, and 10B in their respective colors on the intermediate transfer belt 21.

A superimposed toner image T formed by the above transferring is heat-fused at the heating section X through the intermediate transfer belt 21 by the heat conveyed from the heating roller 22 whose temperature is maintained at 170° C.

Later, the toner image T fused on the intermediate transfer belt 21 is transported to the pressing section (fixing nip section Y) of the pressing roller 24 against the fixing roller 23 as the intermediate transfer belt 21 is turned further. A recording paper P is fed into a space between the intermediate transfer belt 21 and pressing roller 24 at the above transportation timing.

Then, the recording paper P transported to the fixing nip section Y is pressed against the pressing roller 24 through the intermediate transfer belt 21, whereby the fused toner image is fixed onto the recording paper P upon transfer. At the fixing nip section Y, the heat of the intermediate transfer belt 21 and toner image T is conveyed to the fixing roller 23, pressing roller 24, and recording paper P, all of which are maintained at a temperature around the ambient temperature.

Consequently, the toner transferred and fixed onto the recording paper P is cooled and turned into solid, thereby increasing the cohesion among the toner layers. Thus, the offset (residual) of the toner on the surface of the intermediate transfer belt 21 can be prevented without applying thereon a releasing agent, such as silicone oil.

On the other hand, if the offset of the toner occurs on the outer circumferential surface of the intermediate transfer belt 21 by paper jam or the like, the cleaning roller 26 scrapes off the offset toner and paper dust adhering thereon as it touches the same at the downstream end of the fixing nip section Y.

Also, as has been explained, the intermediate transfer belt 21 not only has a small heat capacity, but also conveys its heat to the fixing roller 23, pressing roller 24, and recording paper P at the fixing nip section Y. Further, the intermediate transfer belt 21 releases its heat to an atmosphere in a long transportation segment at its downstream end, and conveys its heat to the pressing section of the tension roller 25 and cleaning roller 26. Thus, the intermediate transfer belt 21 is cooled sufficiently by the time it returns to the pressing section against the visible image forming unit 10Y, and does not give any adverse effect to the photosensitivities of the photosensitive drum 11.

The above-arranged color laser printer is tested in various manners, and the characteristics, functions and effects of the color image forming apparatus of the present invention will be explained with reference to the test results.

To begin with, the results of the fixing test conducted by the above-arranged color laser printer will be set forth below.

(First Test)

Herein, tests (hereinafter, referred to as Examples 1–7) and comparative tests (hereinafter, referred to as Comparative Examples 1–7) are conducted using the above-arranged color laser printer. Here, the transfer/fixing unit 20 of FIGS. 2 and 3 is used commonly in Examples 1–7 and Comparative Examples 1–7.

Figure 2:
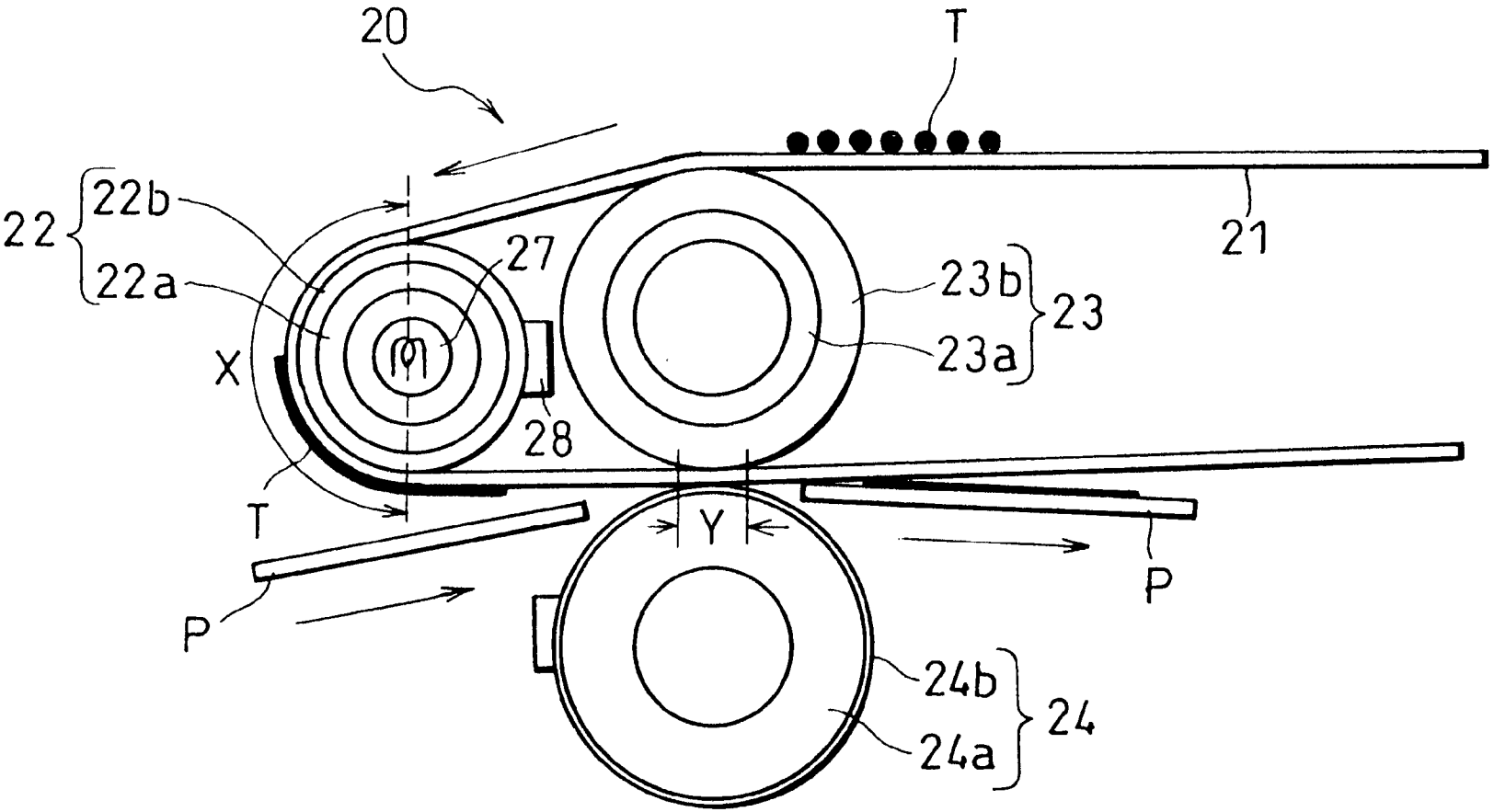
FIG. 2 is a view explaining Examples of a fixing test where the fixing test is carried out by the color laser printer of FIG. 1.

In Examples 1–7, as shown in FIG. 2, the heating roller 22 is activated to raise its temperature from room temperature to a predetermined temperature while the intermediate transfer belt 21 is kept stopped. Subsequently, as soon as the intermediate transfer belt 21 is started to turn, a non-fused toner image T is transferred onto the intermediate transfer belt 21, whereby the non-fused toner image T is heat-fused at the heating section X by the heating roller 22 maintained at the predetermined temperature.

Here, since the heating length of the heating section X is set as long as 23.5 mm, and a heat capacity of the toner image T and intermediate transfer belt 21 is quite small, the toner image T is heated in a satisfactory manner. To be more specific, even in case of a double-layer toner image T, the top layer of the toner image T is exposed to air, but can be heated as high as the surface temperature of the heating roller 22. Consequently, the toner image T heat-fused at the temperature as high as the surface temperature of the heating roller 22 is fixed onto the recording paper P upon transfer at the fixing nip section Y.

Figure 3:
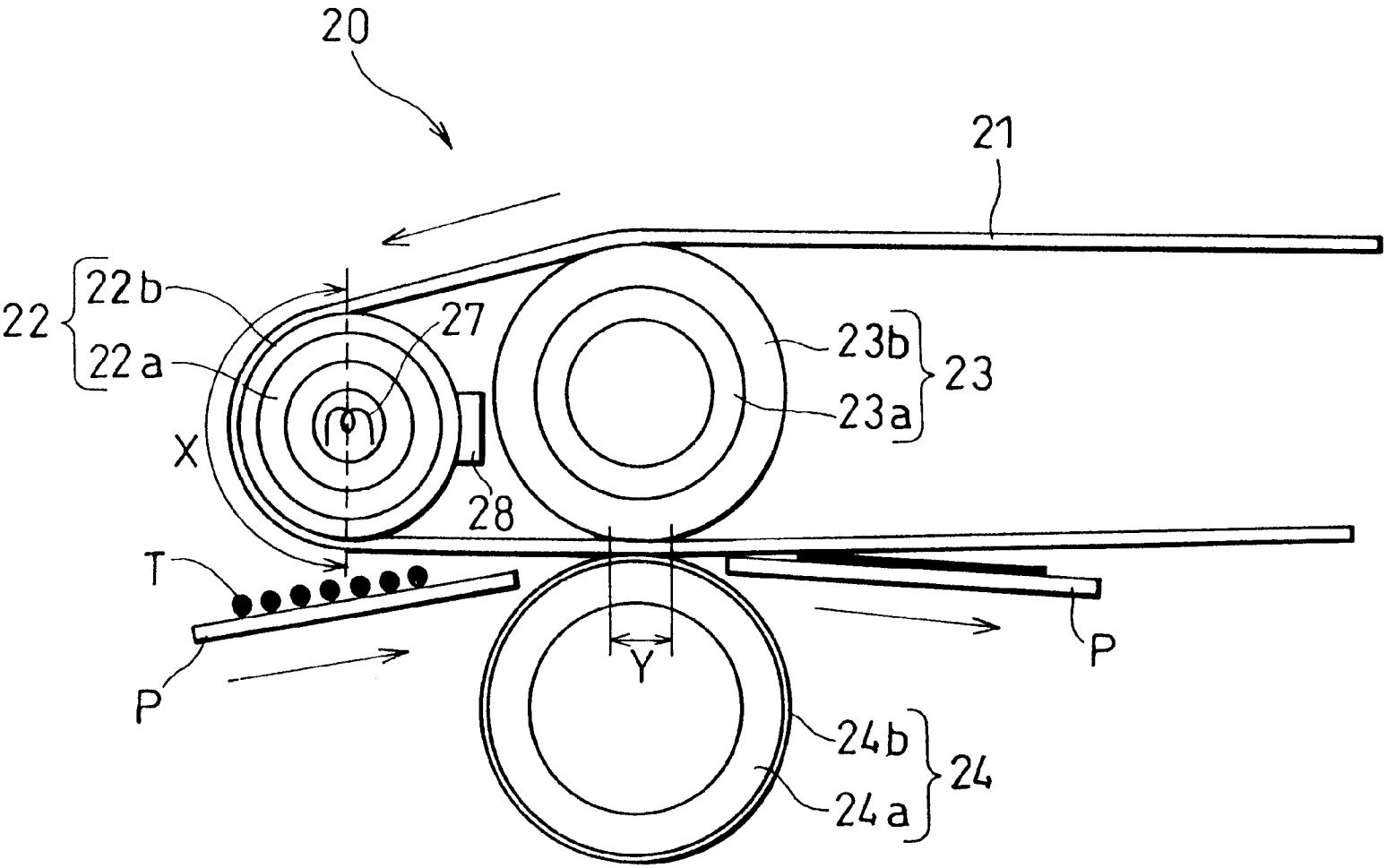
FIG. 3 is a view explaining Comparative Examples by way of comparison with Examples of FIG. 2.

In Comparative Examples 1–7, as shown in FIG. 3, a non-fused toner image T is not transferred onto the intermediate transfer belt 21, but as is in the conventional image forming apparatus, it is transferred onto the recording paper P before being heat-fused, and the toner image T is fixed onto the recording paper P as the recording paper P is transported to the fixing nip section Y along with a intermediate transfer belt 21 heated at the heating section X.

In other words, in Comparative Examples 1–7, the non-fused toner image T is not heated as high as the surface temperature of the heating roller 22. In this case, the non-fused toner image T is merely heated at the fixing nip section Y which is far shorter than the above heating section X.

Figure 4:
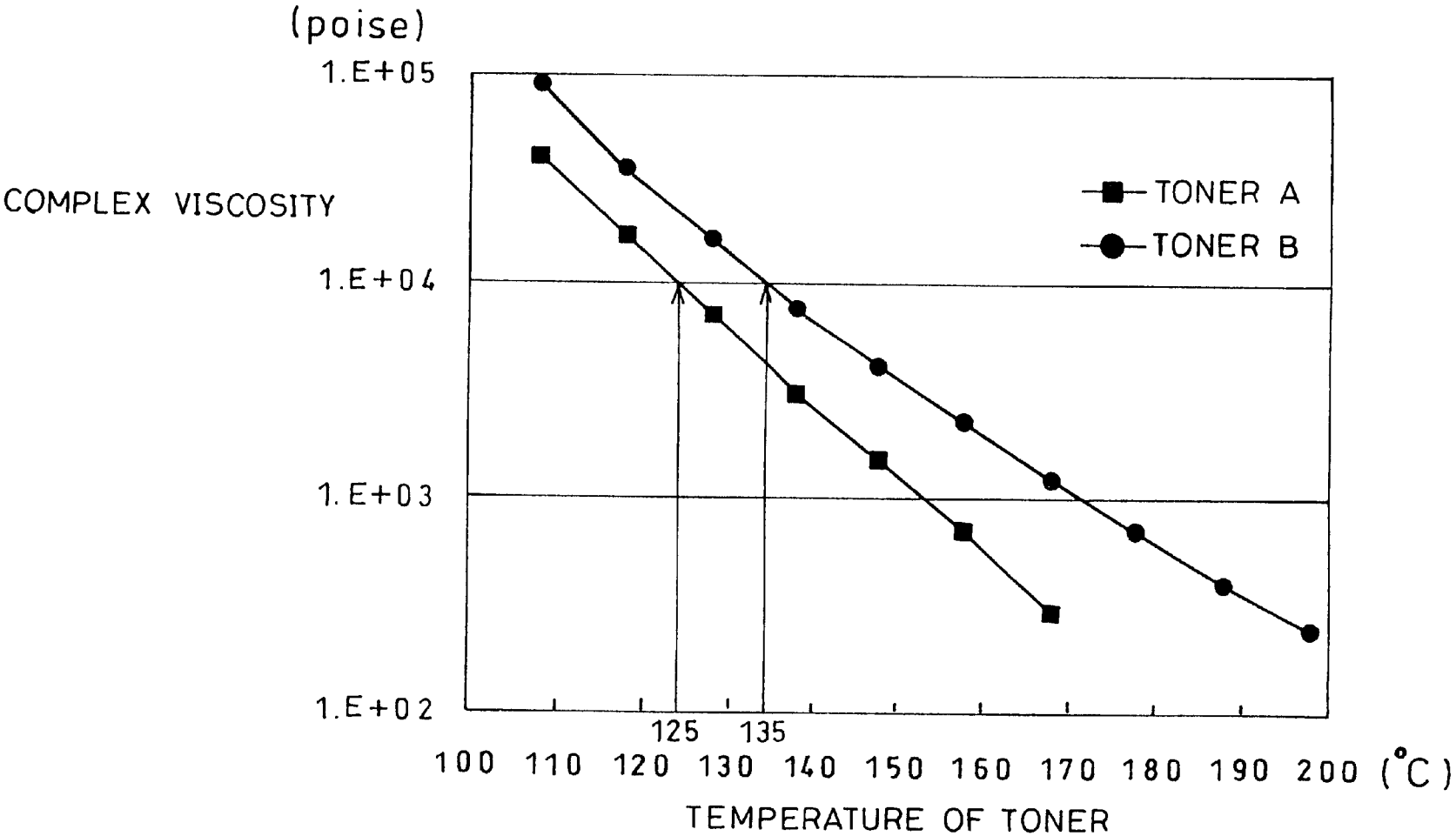
FIG. 4 is a graph showing a relation of temperatures versus complex viscosity of the toner used in the fixing test.

In the fixing tests, toner A (magenta) having a softening point of 102° C. and toner B (magenta) having a softening point of 120° C. are used, whose relations of the temperature versus viscosity (complex viscosity) are respectively shown in FIG. 4. Also, the fixing rate is set to 85 mm/s. The test results of Examples 1–7 and Comparative Examples 1–7 conducted under the above conditions are set forth in Table 1 below.

TABLE 1

| TEST No. | KIND OF TONER | NUMBER OF TONER LAYER(S) | RECORDING PAPER (BASIS WEIGHT) | EXAMPLE/ COMPARATIVE EXAMPLE | FIXABLE TEMP. (° C.) | TEMP. AT INTERFACE (° C.) |
|---|---|---|---|---|---|---|
| 1 | A | 1 | 80 g | 1 | 170 | 125 |
| | | | | 1 | 170 | 110 |
| 2 | B | 1 | 80 g | 2 | 180 | 135 |
| | | | | 2 | 180 | 120 |
| 3 | A | 2 | 80 g | 3 | 170 | 124 |
| | | | | 3 | 185 | 111 |
| 4 | A | 3 | 80 g | 4 | 167 | 124 |
| | | | | 4 | 190 | 111 |
| 5 | A | 4 | 80 g | 5 | 165 | 125 |
| | | | | 5 | 195 | 111 |
| 6 | A | 1 | 52 g | 6 | 175 | 126 |
| | | | | 6 | 180 | 110 |
| 7 | A | 1 | 128 g | 7 | 170 | 125 |
| | | | | 7 | 170 | 109 |

In Table 1, "fixable temperature" means a temperature of the heating roller 22 at which satisfactory fixing strength is obtained as the result of the bending test of the toner image fixed onto the recording paper P while the temperature of the heating roller 22 is varied by 5° C. each time.

Also, "temperature at interface" means a logically computed value of a temperature at the interface between the toner and paper at the fixing nip section Y when the heating roller 22 is heated to the fixable temperature, which is computed by a linear heat transmission simulation by means of the calculus of finite difference. The logical value is used because an actual temperature at the interface between the toner and paper is very difficult to measure.

In the following, a computing method of the temperature at the interface between the toner and paper by means of the logical computation will be explained.

A linear equation of non-steady heat conduction is expressed as:

$$\frac{\partial T}{\partial t} = \frac{\lambda}{\rho c} \cdot \frac{\partial^2 T}{\partial x^2}. \tag{1}$$

where T, t, x, λ, ρ, and c represent temperature, time, distance, heat conductivity, specific gravity, and specific heat, respectively.

By introducing a difference equation by means of spacial discrete from Equation (1) above, we get:

$$T(x, t+\tau) = T(x, t) + \frac{\lambda\tau}{\rho c h^2}[T(x-h, t) - (T(x, t)) + (T(x+h, t) - T(x, t))]. \tag{2}$$

where h represents a distance from one lattice to another and τ represents a very short period of time. Here, if temperatures T at three adjacent lattices (x−h), (x), and (x+h) keeping a very small distance (h) from each other at a given time (t) are known, then temperatures T (x, t+τ) at a very short period of time τ later, that is, at (t+τ), can be computed from Equation (2) above.

Equation (2) above is a difference equation within the same material, but a difference equation on the interface between different materials (a) and (b) can be computed in the same manner as Equation (2) above, which is expressed as:

$$T(x, t+\tau) = T(x, t) + \frac{2\tau}{\rho_a c_a h_a + \rho_b c_b h_b}\left[\frac{\lambda_a}{h_a}\left(T(x-h, t) - (T(x, t))\right) + \frac{\lambda_b}{h_b}(T(x+h, t) - T(x, t))\right] \tag{3}$$

The other analysis conditions are set forth as follow:

① heat transfer in the axial and circumferential directions is not concerned, and heat transfer in the thickness (linear) direction alone is concerned;

② irradiation and heat transmission by natural convection current are concerned as a heat loss from the surface of the fixing roller;

③ physical properties depend on a temperature of air alone;

④ the toner layer is uniform (printing at 100%) and the layer thickness does not vary before and after the fixing;

⑤ the variance of the physical properties with a change in phase of the toner is not concerned;

⑥ contact heat resistance is not concerned;

⑦ a temperature at the interface at the instance when two subjects (for example, toner and fixing roller) touch with each other at an inlet of the fixing nip section is defined as an average of the temperatures of the two subjects before they touch with each other which are weighted with the heat capacity; and ⑧ evaporation heat of the moisture contained in the recording paper is not concerned.

Thus, if temperatures of the intermediate transfer belt 21 before entering into the fixing nip section, fixing roller 23, pressing roller 24, toner, recording paper P, and atmosphere are measured as the initial conditions at the time t=0, then a change in temperature at each component after the lapse of an arbitrary time $\tau$ can be computed by the above computation method. In the present fixing tests, since the fixing rate is set to 85 mm/s and the fixing nip length is set to 4.5 mm, a temperature at the interface between the toner and paper over a time $\tau$=4.5/85=53 ms is computed in accordance with the above equation.

Note that the above computing method is an example for finding a temperature at the interface between the toner and paper, and it should be appreciated that the temperature at the interface between the toner and paper can be found by any other applicable method. For example, the above method adopts the explicit method of the difference equation, but the implicit method of the difference equation can be adopted as well. Alternatively, the linear equation may be expanded to a quadratic equation to further improve the computation accuracy. Further, besides the heat transmission simulation, a temperature at the interface between the toner and paper may be inferred empirically based on the results of various kinds of tests.

Next, the test results will be detailed in the following.

As has been explained, in Examples, the non-fused toner image T is heat-fused on the intermediate transfer belt 21, and fixed onto the recording paper P at the fixing nip section Y upon transfer. The result of Test No. 1 reveals that, in case of a single-layer toner image, a temperature of the heating roller 22 (≈temperature of toner image T) must be set to a temperature (170° C.) far higher than the toner softening point (102° C.) to secure satisfactory fixing strength.

Also, the result of the Comparative Example, where the non-fused toner image T is transferred onto the recording paper P and fixed thereon upon heating together with the recording paper P at the fixing nip section Y, reveals that the fixable temperature must be set to 170° C. as well. Thus, in case of a single-layer toner image, the fixable temperatures are the same in the Example and Comparative Example.

Thus, in case of a monochrome laser printer handling a single-layer toner image, the fixing energy is about the same whether the toner image is heat-fused and fixed onto the recording paper upon transfer or the toner image is fixed onto the recording paper upon heating with the recording paper.

The reason why is as follows. Even when the toner image T is heat-fused and fixed onto the recording paper upon transfer as it is in the Example, if the recording paper P is too cold, no matter how satisfactorily the toner is heat-fused, the toner is cooled and turned into solid as its heat is conveyed to the recording paper P before it impregnates into the microscopic spaces among the fibers of which the recording paper P is made. To solve this problem, the toner and intermediate transfer belt 21 must be heated exceedingly to raise the temperature of the recording paper P satisfactorily as well. Further, although it will be described below, if a temperature at the interface between the toner and paper is low, the same fixing strength can be attained more readily by fixing the toner image after it is transferred onto the recording paper.

However, in case of a double-layer toner image, the result of the Test No. 3 reveals the following. That is, in the case of the Example, the fixable temperature of the heating roller 22 is the 170° C., which is the same as the fixable temperature in the case of the single-layer toner image (Test No. 1). By contrast, in the case of the Comparative Example, a temperature of the heating roller 22 must be raised to 185° C., which is 15° C. higher than the temperature in the case of the single-layer toner image. Thus, in the case of the double-layer toner image, the fixing energy can be saved in the Example compared with the Comparative Example.

The reason why is as follows. In the Example, since the heating section X of the heating roller 22 is sufficiently long (23.5 mm), the toner image can be heated uniformly regardless of the layer thickness. Whereas in the Comparative Example, since a temperature at the interface between the toner and paper must be raised sufficiently high at the fixing nip section Y (fixing nip length: 4.5 mm), which is far shorter than the heating section X, the heat is not conveyed sufficiently to the interface between the toner and paper if the toner layer is too thick.

In the case of triple-layer and quadruple-layer toner images thicker than the double-layer toner images, the results of Test Nos. 4 and 5 reveal that, in the Examples, the fixable temperatures of the heating roller 22 are 167° C. and 165° C., respectively, which are about the same as the one in the case of the single-layer toner image (Test No. 1).

On the other hand, the results of the Test Nos. 4 and 5 reveal that, in the Comparative Examples, the fixable temperatures of the heating roller 22 are 190° C. and 195° C., respectively, which are higher by 23° C. and 30° C. than those in the corresponding Examples. In other words, in Comparative Examples, the fixing energy must be increased compared to the fixing energy required in the Examples.

As can be understood from the foregoing, the color image forming apparatus of the present embodiment, which heat-fuses the toner image T on the intermediate transfer belt 21 and fixes the same onto the recording paper P upon transfer, can offer a merit that the fixing energy can be saved when used as an apparatus for forming a color image by transferring a superimposed multi-layer toner image onto the recording sheet.

In the case of a color image composed of the toner image T having different layer thicknesses, if the toner image T is fixed onto the recording paper upon heat-fusing at the fixing nip section by the conventional image forming apparatus, the following problem occurs. That is, the conventional image forming apparatus can not attain stable fixing properties, because the single-layer toner image portion is heated too much and causes a high-temperature offset, while the double-, triple-, or quadruple-layer toner image is not heated sufficiently, and a low-temperature offset or fixing deficiency occurs.

On the other hand, in the case of the color image forming apparatus which heat-fuses the toner image T on the intermediate transfer belt 21 and fixes the same onto the recording paper P upon transfer like in the Examples, as the test results reveal, the fixing conditions do not have to be changed with the toner layer thickness (the fixable temperature is maintained at 170° C.). Thus, the color image forming apparatus arranged in the same manner as the Examples can offer a merit that constant, stable fixing properties can be attained without causing fixing deficiency and high-temperature offset.

The results of Test Nos. 1–5 reveal that, in the Examples, sufficient fixing strength can be attained regardless of the kinds of the recording papers and toner layer thickness when a temperature at the interface between the toner and paper is 125° C. or above with the toner A, and 135° C. or above with the toner B.

As shown in FIG. 4, when a temperature of the toner A is 125° C. and a temperature of the toner B is 135° C., both the toner A and toner B have toner viscosity (complex viscosity) of 10000 (1.E+04) poise. Thus, it can be understood that if a temperature at the interface between the toner and paper is raised to a level such that keeps the toner viscosity at 10000 poise or below, sufficient fixing strength can be attained in a reliable manner.

On the other hand, the condition for attaining sufficient fixing strength in the Comparative Examples is: a temperature at the interface between the toner and paper is 110° C. or above with the toner A, and 120° C. or above with the toner B. Thus, the toner image T can be fixed onto the recording paper P at a temperature 15° C. lower than those in the Examples. The reason why the substantially same fixing strength is obtained at a lower temperature in the Comparative Examples is assumed that, in case that the non-fused toner image is transferred onto the recording paper and fixed thereon upon heating like in the Comparative Examples (conventional method), static electricity acts on the toner by the electric charges generated on the back side of the recording paper upon transfer, and the toner readily impregnates into the microscopic spaces among the fibers of which the recording paper is made.

Besides the above-described method (method of computing a temperature at the interface between the toner and paper), the necessary fixing conditions can be found more easily in the following manner.

Since the test results reveal that the fixable temperature is 170° C. for the toner A having a softening point of 102° C., and 180° C. for the toner B having a softening point of 120° C., sufficient fixing properties can be secured if the heating roller 22 is controlled to stay at a temperature higher than the softening point by 60° C. or more.

The toner is heated for a sufficiently long period by the heating roller 22 at the heating section X. Thus, a temperature of the toner is raised substantially as high as the temperature of the heating roller 22, and the heat is hardly lost while the toner is transported from the heating section X to the fixing nip section Y. Thus, a temperature of the toner right before it goes into the fixing nip section Y to be fixed onto the recording paper P upon transfer is substantially the same as the temperature of the heating roller 22.

Thus, let T3 be the softening point temperature of the toner and T4 be the temperature of the toner right before it is fixed onto the recording paper P upon transfer, then sufficient fixing properties can be secured if a temperature of the heating roller 22 is set to satisfy: $T4-T3 \geqq 60$(° C.).

Next, the results of the Test Nos. 1, 6 and 7 reveal that, in the Examples, the fixable temperature remains in a range between 170–175° C. and does not substantially vary regardless of the kinds (basis weights) of the recording papers P.

On the other hand, in the case of the typical conventional fixing device adopting a heating roller method used in the Comparative Examples, the fixing temperature must be varied with the basis weights of the recording papers. To be more specific, the fixing temperature is raised when the basis weight is increased to prevent the deterioration of the fixing properties with a rise in temperature. Conversely, the fixing temperature is lowered when the basis weight is reduced to prevent too much improvement on the fixing proprieties, so that the toner is not fixed exceedingly. The reason why is as follows. In the conventional fixing device adopting the heating roller method, the heating of the toner depends on not only temperature of the fixing roller, but also the temperature of the pressing roller. Thus, under these conditions, when the basis weight (thickness of the recording paper) varies, so does a quantity of heat conveyed from the pressing roller to the toner through the recording paper.

However, the color image forming apparatus of the Examples has the following characteristics.

① Since the heating roller 22 serving as the heat source and the pressing roller 24 are spaced apart, the heat is not directly conveyed to the pressing roller 24.

② Since the intermediate transfer belt 21 is kept stopped while the heating roller 22 is warming up, the heat is not conveyed to the pressing roller 24 during the warm-up period, either.

③ Since the high heat-insulating recording paper P is interposed in a space between the intermediate transfer belt 21 and pressing roller 24 when the toner image T is fixed onto the recording paper P upon transfer, the heat is hardly conveyed to the pressing roller 24.

④ Since a heat capacity of the pressing roller 24 is far larger than a very small heat capacity of the intermediate transfer belt 21, a temperature of the pressing roller 24 is not raised much by the heat conveyed from the intermediate transfer belt 21, even when intermediate transfer belt 21 touches the pressing roller 24 directly after the recording paper P is released and before the next recording paper P is transported.

⑤ Since the pressing roller 24 is made of a high heat conducting material (aluminum), heat conveyed to the surface of the pressing roller 24 is quickly conveyed and distributed to the interior thereof, so that a temperature is uniform throughout the pressing roller 24, and therefore, a temperature of the pressing roller 24 does not rise much.

For the reasons specified above, in the Examples, a temperature of the pressing roller 24 is maintained at a temperature (20–40° C.) substantially the same as the ambient temperature, and hardly affects the fixing of the toner at the fixing nip section Y. For this reason, the fixing properties hardly vary even if the basis weight of the recording paper P changes. In other words, as the result of the Test No. 6 reveals, if the recording paper P has a small basis weight, the fixable temperature tends to rise because the heat of the intermediate transfer belt 21 is readily released to the pressing roller 24 through the recording paper P, but the variance is as small as 5° C. and negligible.

The same can be said when the kinds of the recording papers P (normal papers, envelopes, postcards, labels, etc.) are changed.

Thus, the color image forming apparatus of the Examples can readily attain constant, stable fixing properties regardless of the kinds or thickness (basis weights) of the recording paper P.

Next, to prove the effects of the pressing roller 24 in the above-arranged color laser printer, the following test is conducted.

(Second Test)

Figure 5:
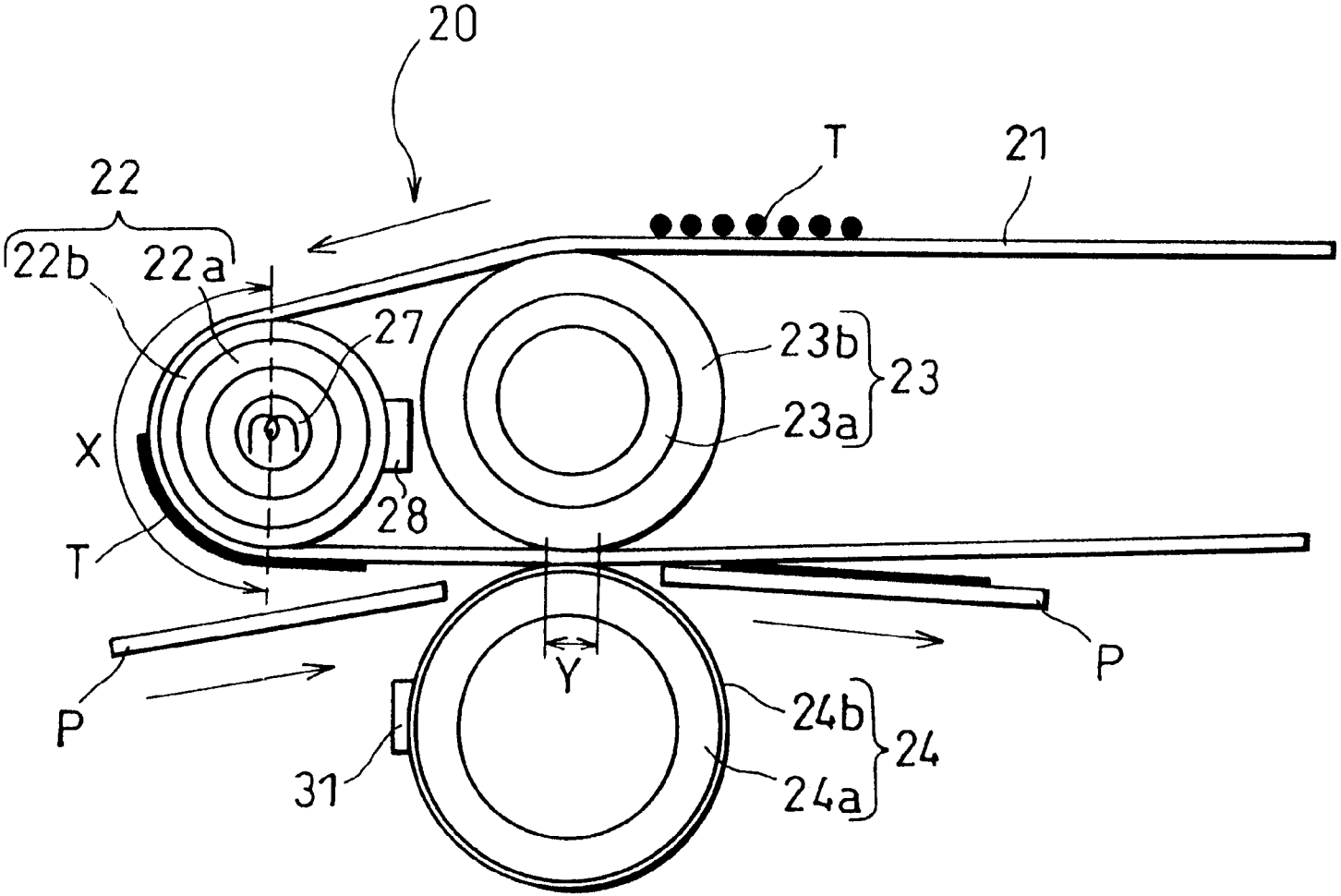
FIG. 5 is a view explaining an Example of a test for confirming an effect of a pressing roller of the color laser printer of FIG. 1.
Figure 6:
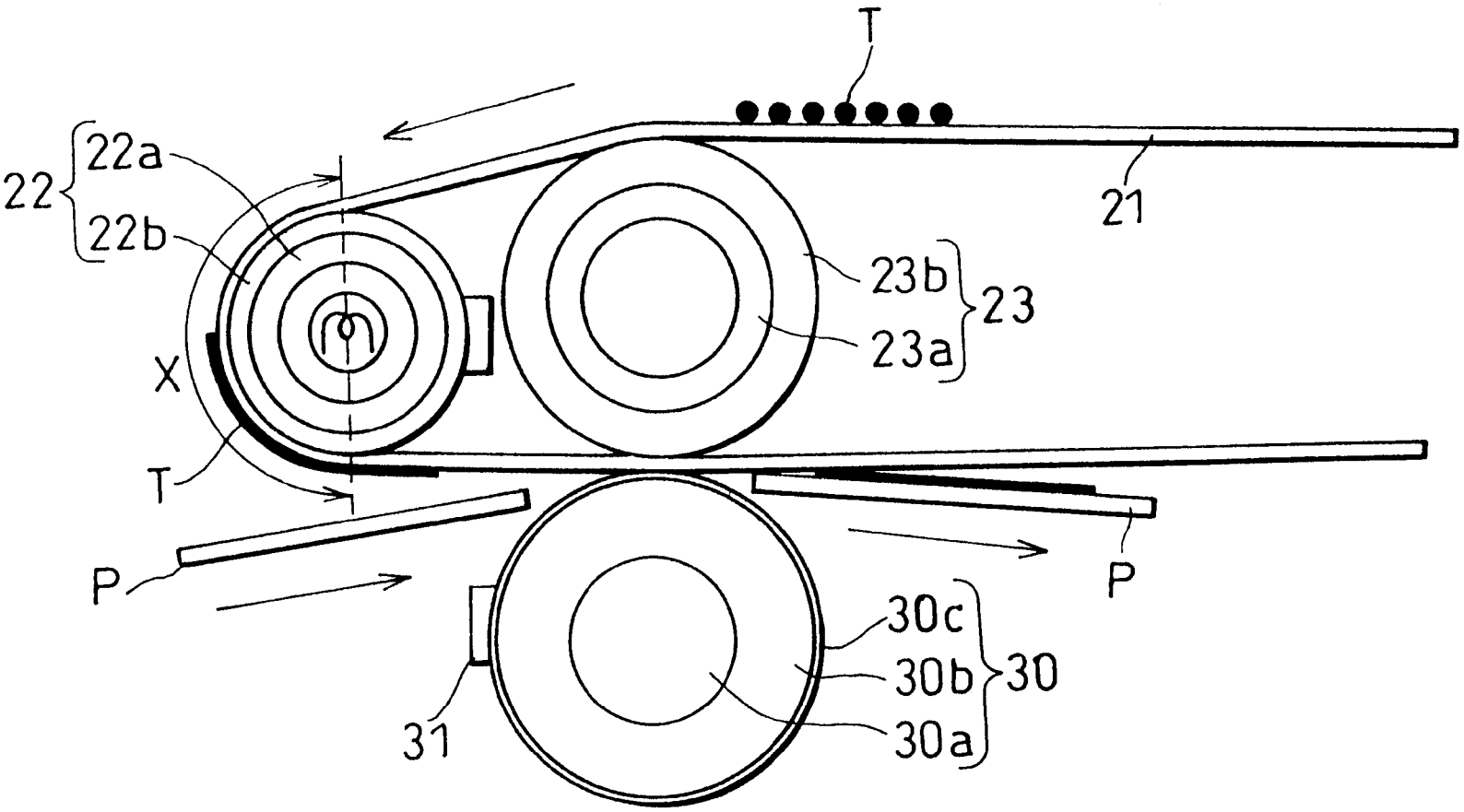
FIG. 6 is a view explaining a Comparative Example of the test for confirming an effect of the pressing roller of the color laser printer of FIG. 5.
Figure 7:
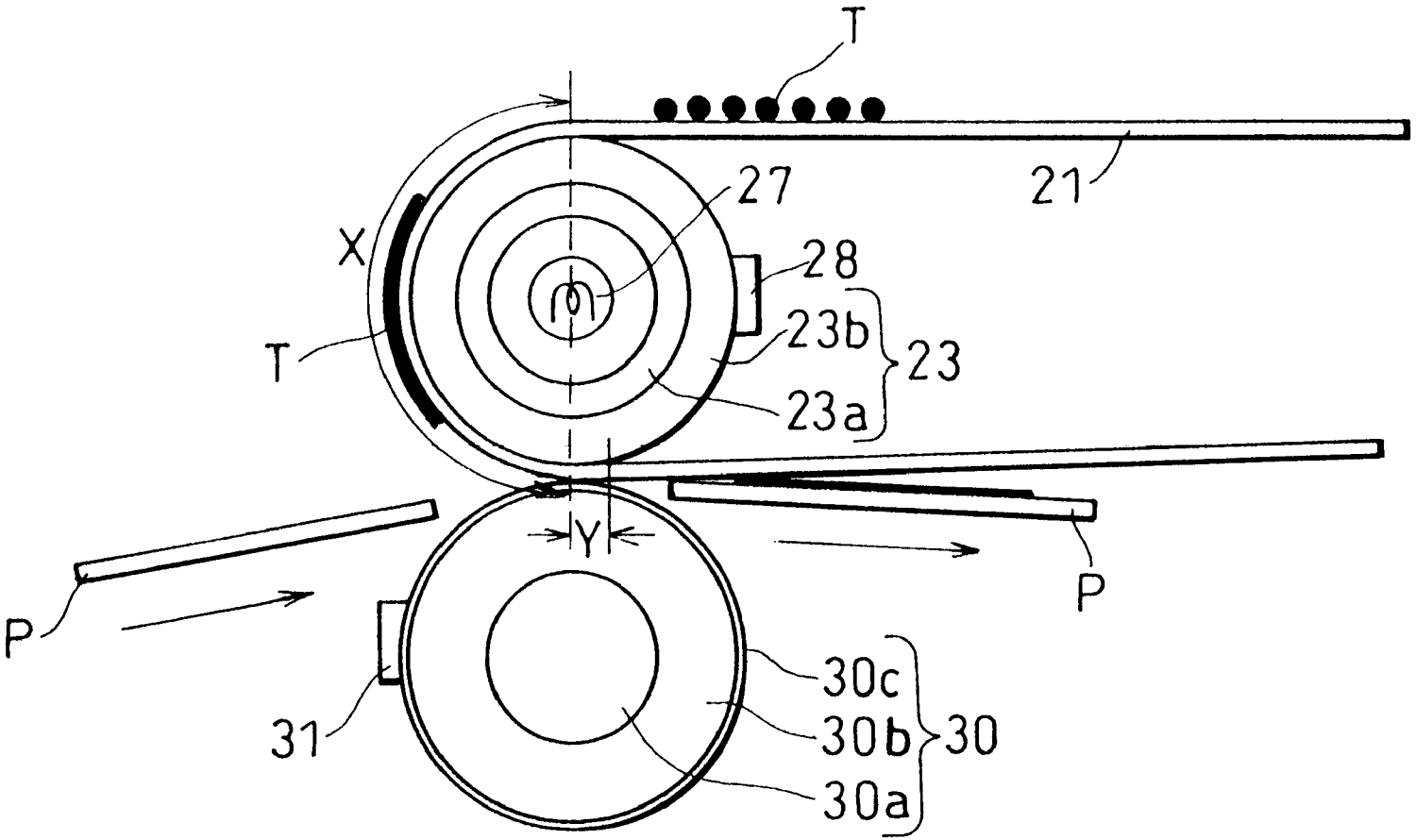
FIG. 7 is a view explaining another Comparative Example of the test for confirming an effect of the pressing roller of the color laser printer of FIG. 5.

An arrangement of an apparatus used in the present test is depicted in FIGS. 5 through 7.

The test (hereinafter, referred to as Example 8) using the above-arranged color laser printer is conducted to evaluate the quality of the fixed image formed by the transfer/fixing unit 20 of FIG. 5.

To be more specific, in Example 8, a non-fused toner image T is transferred on the intermediate transfer belt 21, and heat-fused at the heating section X by the heating roller 22 controlled to stay at a predetermined temperature. Then, a recording paper P is fed to the fixing nip section Y, and the heat-fused toner image T is fixed onto the recording paper P upon transfer. The above series of image forming process is repeated continuously for 100 papers. A temperature of the pressing roller 24 is monitored by a temperature sensor 31 every time a certain number of papers have been fed, and the quality of the fixed image is evaluated as well.

In Comparative Example 8, the quality of the fixed image is evaluated in the same manner as above except that the pressing roller 24 of FIG. 5 is replaced with a pressing roller 30 of FIG. 6.

To be more specific, the pressing roller 30 of Comparative Example 8 is composed of an aluminum column 30*a* having a diameter of 15 mm coated with a 7.5 mm-thick elastic layer 30*b* made of foam silicone rubber, which is covered with a tube of a 50 $\mu$m-thick releasing layer 30*c* made of fluoride resin (tetrafluoroethylene-parfluoroalkylvinyl ether copolymer or PFA for short). Here, a heat capacity Cr' of the pressing roller 30 per unit area in Comparative Example 8 is computed in the following manner by taking only the heat capacity of the PFA tube 30*c* serving as the releasing layer into consideration, because the elastic foam silicone rubber layer 30*b* has excellent heat insulation:

Given that:

specific heat of PFA: 1.05 J/9° C.

specific gravity of PFA 2.14 g/cm$^3$, then, $$Cr'=[1.05\times2.14\times(1.505^2-1.5^2)\pi]/(3\pi)=0.011\ J^\circ/C.$$

Since the heat capacity Cb of the intermediate transfer belt 21 is 0.0327 J/° C., Cr'<Cb in Comparative Example 8. In other words, since the heat capacity Cr' of the pressing roller 30 is smaller than the heat capacity Cb of the intermediate transfer belt 21, it is impossible to prevent a rise in temperature of the pressing roller 30 by the heat conveyed from the intermediate transfer belt 21.

Also, Comparative Example 9 is conducted in the manner shown in FIG. 7 by omitting the heating roller 22 and using the pressing roller 30 of FIG. 6.

In other words, Comparative Example 9 is conducted in the same manner as Example 8 and Comparative Example 8 using the above arrangement.

The toner A (magenta) having a softening point of 102° C. used in First Test is also used herein. The other test conditions are as follows:

recording paper P: 80 g fixing rate: 85 mm/s.

The test results of Example 8 and Comparative Examples 8 and 9 are set forth in Table 2 below.

TABLE 2

| PRESSING ROLLER | TEMP. OF HEATING ROLLER (° C.) | | NUMBERS OF PRINTED PAPERS 1 | 25 | 50 | 75 | 100 |
|---|---|---|---|---|---|---|---|
| EXAMPLE 8 | 170 | TEMP. OF PRESSING ROLLER (° C.) | 25 | 29 | 32 | 34 | 35 |
| | | FIXED IMAGE | ○ | ○ | ○ | ○ | ○ |
| COMPARATIVE EXAMPLE 8 | 170 | TEMP. OF PRESSING ROLLER (° C.) | 25 | 56 | 75 | 82 | 86 |
| | | FIXED IMAGE | ○ | ○ | ○ | ○ | X(H) |
| | 160 | TEMP. OF PRESSING ROLLER (° C.) | 25 | 51 | 70 | 78 | 83 |
| | | FIXED IMAGE | X(L) | ○ | ○ | ○ | ○ |
| COMPARATIVE EXAMPLE 9 | 170 | TEMP. OF PRESSING ROLLER (° C.) | 25 | 80 | 123 | 132 | 138 |
| | | FIXED IMAGE | ○ | ○ | X(H) | X(H) | X(H) |
| | 160 | TEMP. OF PRESSING ROLLER (° C.) | 25 | 75 | 118 | 128 | 135 |
| | | FIXED IMAGE | X(L) | ○ | ○ | X(H) | X(H) |

○: Satisfactory
X(H): High-temperature offset
X(L): Low-temperature offset (fixing deficiency)

Table 2 above reveals that in the color image forming apparatus of Example 8 shown in FIG. 5, the heating roller 22 serving as the heat source is spaced apart from the pressing roller 24, and the heat capacity of the pressing roller 24 is far larger than the heat capacity of the intermediate transfer belt 21. In this case, stable fixing properties are obtained because the temperature of the pressing roller 24 does not vary much and remains around room temperature (25–35°), and if the images are printed out successively on the 100 recording papers, the image quality can be maintained satisfactorily without causing the high-temperature offset or fixing deficiency.

However, as in Comparative Example 8, even when the heat source is spaced apart from the pressing roller 30, if the pressing roller 30 has a small heat capacity, a temperature of the pressing roller 30 rises as the images are printed out successively on the 100 recording papers, and the high-temperature offset occurs at the end of the print-out job (while a temperature of the heating roller 22 is kept at 170° C.). On the other hand, if a temperature of the heating roller 22 is dropped (160° C.) to prevent the high-temperature offset, the low-temperature offset occurs on the first recording paper. Thus, the fixing properties are not stabilized.

Further, when the fixing roller 23 and pressing roller 24 are provided closely as in Comparative Example 9, a larger quantity of heat is conveyed to the pressing roller 24. For this reason, a temperature of the pressing roller 24 varies much in Comparative Example 9 compared with the result in Comparative Example 8, thereby making it more dificult to stabilize the fixing properties.

Thus, as can be understood from the foregoing test results, to stabilize the fixing properties, the transfer/fixing unit 20 in the color image forming apparatus is arranged in the same manner as Examples 1–8. To be more specific:

① the heating means (heating roller 22, herein) is spaced apart from the pressing roller 24;

② the pressing roller 24 is composed of a high heat conducting member having a larger heat capacity than the intermediate transfer belt 21 (more preferably, a heat capacity per unit area is 30 times or more of the heat capacity of the intermediate transfer belt 21 as in the Example).

Embodiment 2

Figure 8:
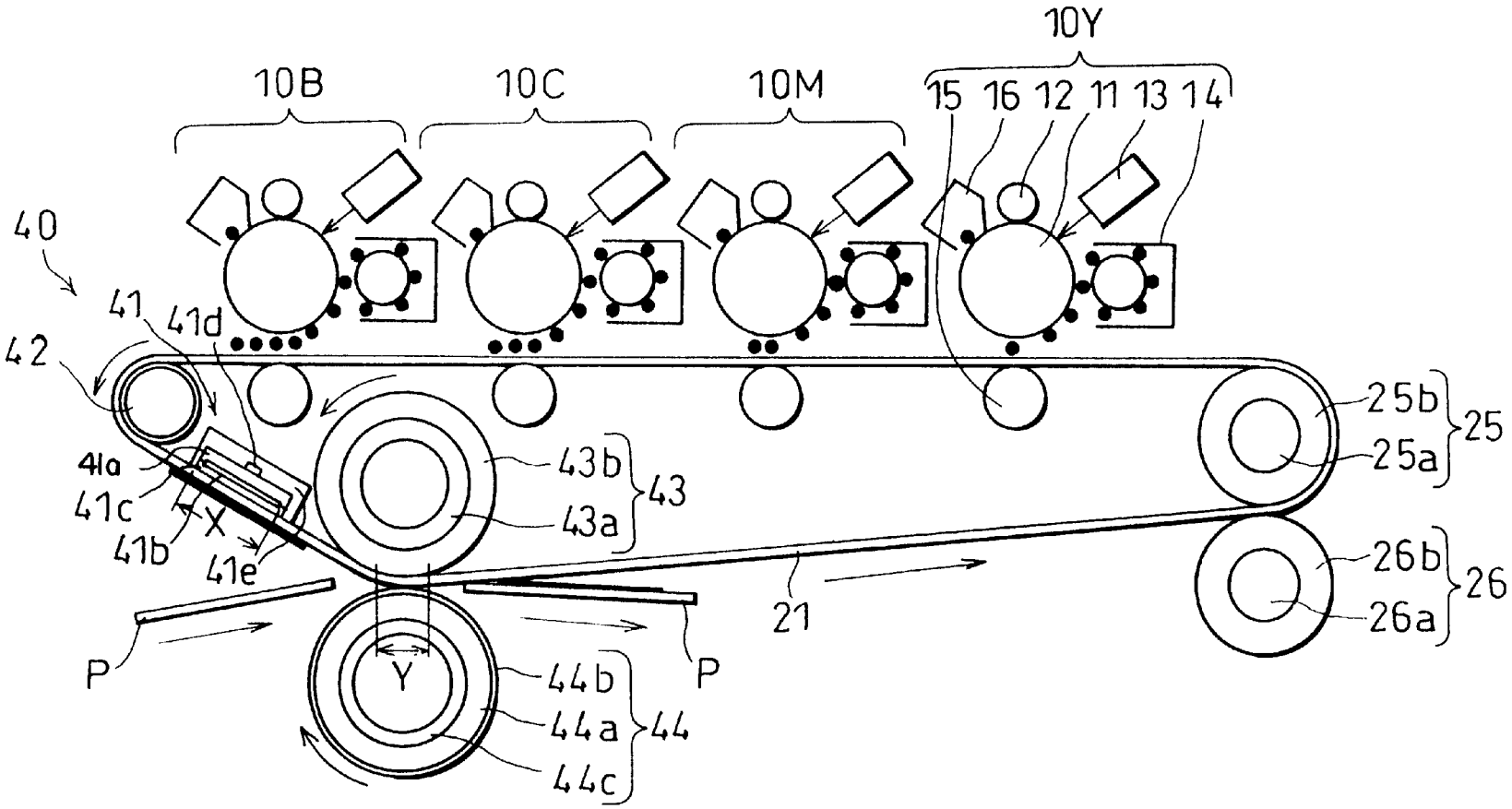
FIG. 8 is a view schematically showing an arrangement of a color laser printer in accordance with another example embodiment of the present invention.

Referring to FIG. 8, the following description will describe another example embodiment of the present invention. Since a color image forming apparatus of the present embodiment is identical with its counterpart in Embodiment 1 above except for the heating means, fixing roller 23 and pressing roller 24, like numerals are labeled to like components and the explanation of these components is not repeated for the explanation's convenience.

As shown in FIG. 8, the color image forming apparatus of the present embodiment includes four visible image forming units 10Y, 10M, 10C, and 10B as image forming means, and a transfer/fixing unit 40.

The transfer/fixing unit 40 is composed of an intermediate transfer belt 21, a supporting roller 42, a fixing roller 43, a pressing roller 44, a tension roller 25, a cleaning roller 26, and a thermal heater 41.

The intermediate transfer belt 21 is bridged across the supporting roller 42, fixing roller 43, and tension roller 25. The thermal heater 41 is provided fixedly as heating means at the downstream end of the supporting roller 42 along the turning direction of the intermediate transfer belt 21 in such a manner to touch the inner circumferential surface of the intermediate transfer belt 21. In short, the thermal heater 41 is positioned at the upstream end of the pressing roller 44.

The thermal heater 41 is composed of an alumina ceramic substrate 41*a* having thereon printed a planar Mo-based heating resistor 41*b* (planar heating body) serving as a heating source, a ceramic heater having thereon printed a layer of glass coat 41*c*, a temperature sensor 41*d* provided beneath the ceramic heater, and a heater holder 41*e* supporting the ceramic heater while insulating the heat therefrom.

The thermal heater 41 rises up as soon as the current starts to pass through the heating resistor 41*b*, and controls the current passing based on a signal from the temperature sensor 41*d*, so that it stays at a predetermined temperature (170° C., herein). Consequently, a toner image T is transferred on the surface of the intermediate transfer belt 21, and transported further to the pressing section (heating section X) with the thermal heater 41 to be heat-fused.

The fixing roller 43 is composed of an aluminum column 43*a* having a diameter of 20 mm and coated with a 5 mm-thick heat-resistant elastic layer 43*b* made of foam silicone rubber. Since foam silicone rubber has small heat conductivity and excellent heat insulation as well as satisfactory elasticity, sufficient fixing nip length Y can be secured at a low pressure. Also, since the foam silicone rubber has small heat conductivity, a quantity of the heat released from the intermediate transfer belt 21 to the fixing roller 43 can be minimized. Hence, the intermediate transfer belt 21 is allowed to touch the fixing roller 43 at the upstream end of the fixing nip section Y. This means that the intermediate transfer belt 21 can be bridged across the rollers in a more flexible manner, thereby realizing more flexible design for the color image forming apparatus.

The pressing roller 44 is composed of an aluminum drum 44*a* having a diameter of 30 mm and a thickness of 3 mm and coated with a 10 $\mu$m-thick releasing layer 44*b* made of fluoride resin (polytetrafluoroethylene or PTFE for short). Moreover, the interior of the drum 44*a* is of a heat-pipe structure. In other words, although it is not illustrated in the drawing, a portion touching the intermediate transfer belt 21 in the longitudinal direction of the pressing roller 44 is a heat absorbing section, and a corresponding outside portion is a heat releasing section.

A coagulating liquid (not shown) for delivering heat from the heat absorbing section to the heat releasing section is sealed in the drum 44*a*, and a wick 44*c*, which returns the coagulating liquid from the heat releasing section to the heat absorbing section by means of capillary, is provided on the inner circumferential surface of the drum 44*a*.

As has been explained, by adopting the heat-pipe structure to the pressing roller 44, the heat conveyed to the pressing roller 44 from the intermediate transfer belt 21 is immediately released from the releasing section, so that the pressing roller 44 is constantly kept substantially as high as the ambient temperature. Consequently, stable fixing properties can be attained regardless of the operation conditions and the kinds or thickness of the recording paper P.

In Embodiments 1 and 2 above, the intermediate transfer belt 21 is used as an example image carrying body. However, the image carrying body of the present invention is not limited to a belt, and for example, a drum can be used as the image carrying body as well, and example of which will be explained in Embodiment 3 below.

Embodiment 3

Figure 9:
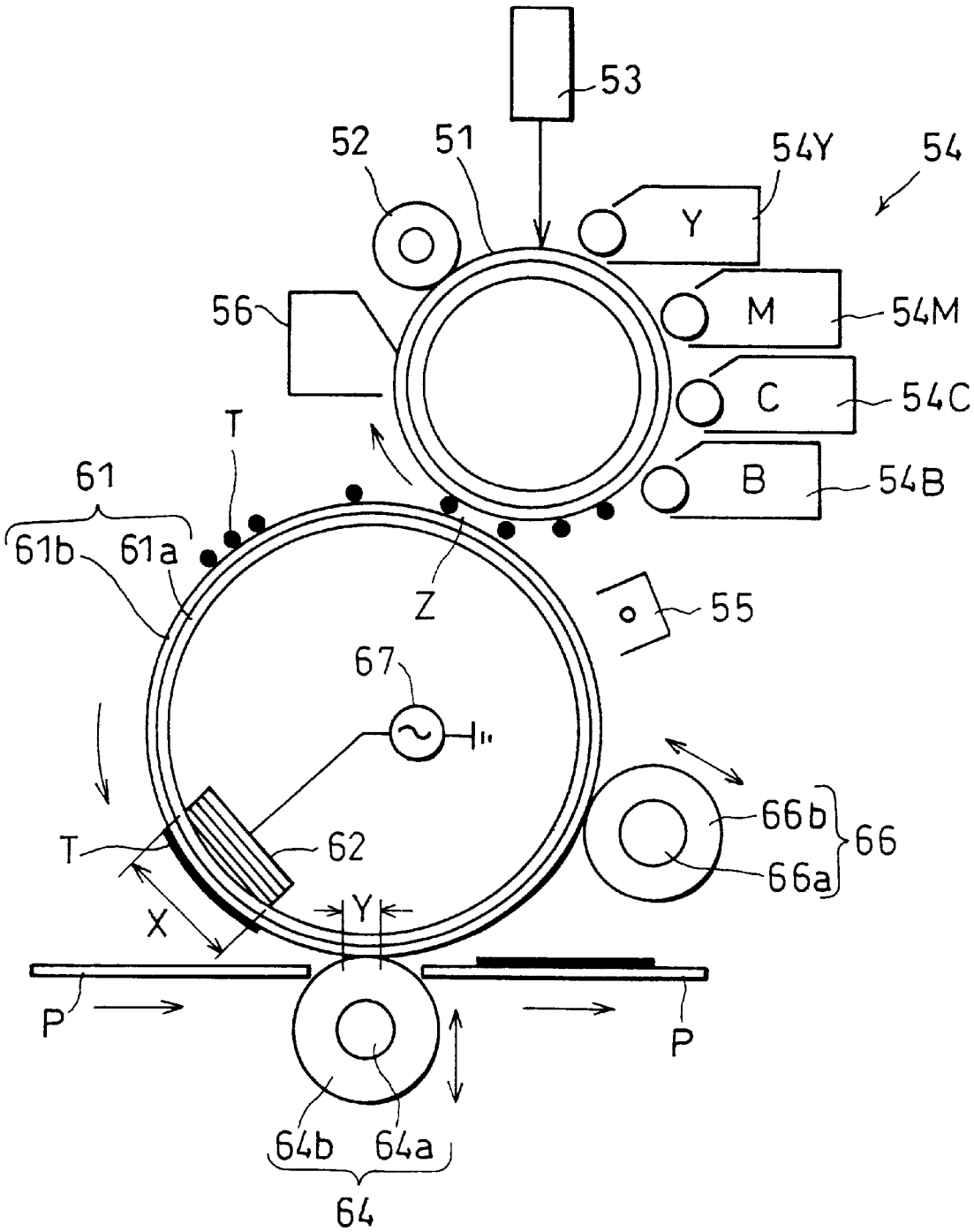
FIG. 9 is a view schematically showing an arrangement of a color laser printer in accordance with still another example embodiment of the present invention.
Figure 10:
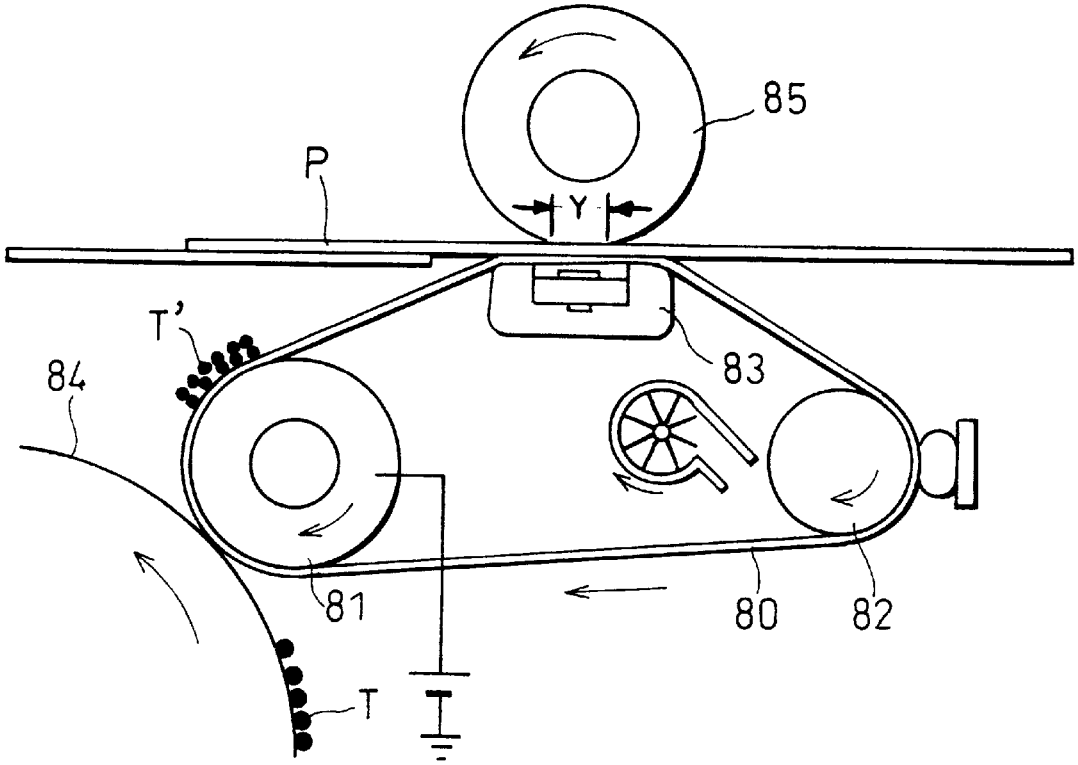
FIG.10 PRIOR ART
FIG. 10 is a view schematically showing an arrangement of a conventional image forming apparatus.
Figure 11:
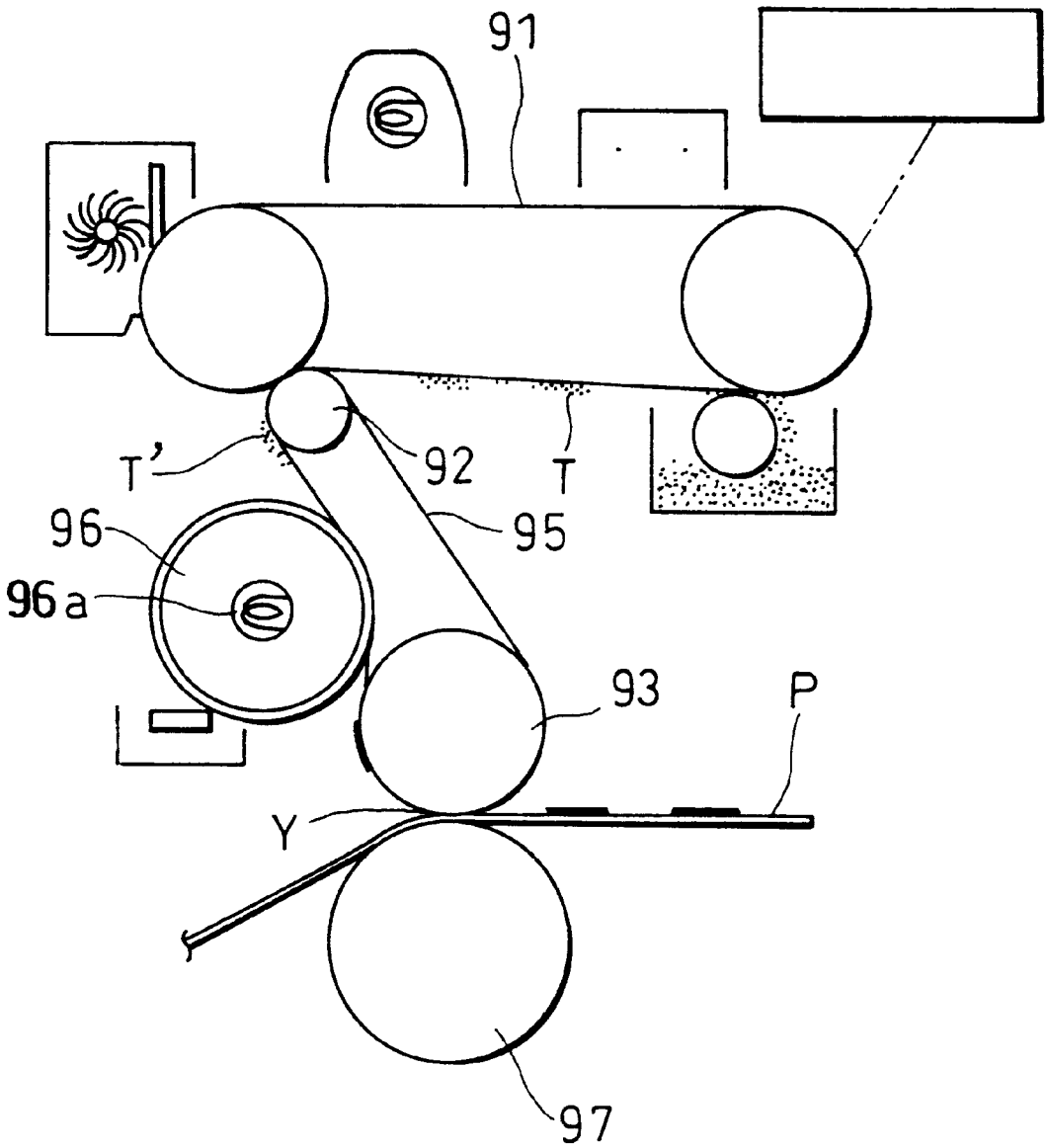
FIG.11 PRIOR ART
FIG. 11 is another view schematically showing an arrangement of a conventional image forming apparatus.

Referring to FIG. 9, the following description will describe still another example embodiment of the present invention. In the present embodiment, a color laser printer is used as an example image forming apparatus of the present invention.

As shown in FIG. 9, unlike the counterparts in Embodiments 1 and 2, the color laser printer of the present embodiment includes an intermediate transfer drum (image carrying drum) 61 as the image carrying body instead of the intermediate transfer belt 21.

Around the intermediate transfer drum 61, a photosensitive drum 51, a corona charger 55, a cleaning roller 66, and a pressing roller 64 are provided sequentially.

Around the photosensitive drum 51, a charging roller 52, a laser irradiating device 53, a developing device 54, and a cleaner 56 are provided sequentially.

The charging roller 52 is provided as charging means for electrically charging the surface of the photosensitive drum 51 uniformly, and the laser irradiating device 53 is provided as laser beam irradiating means for forming an electrostatic latent image on the surface of the photosensitive drum 51 which has been electrically charged uniformly. Assume that the electrostatic latent image is formed for each color.

The developing device 54 is provided as visible image forming means for developing the electrostatic latent image formed on the photosensitive drum 51 into a visible image. To form a color image, the developing device 54 includes four developers: a developer 54Y for forming a yellow toner image; a developer 54M for forming a magenta toner image; a developer 54C for forming a cyan toner image; and a developer 54B for forming a black toner image.

To be more specific, the electrostatic latent images formed on the photosensitive drum 51 for their respective colors are developed into visible toner images in their respective colors by the developers 54Y, 54M, 54C, and 54B, and transported onto the intermediate transfer drum 61 to be superimposed sequentially one on another, whereby a multi-color toner image for a color image is formed on the intermediate transfer drum 61.

The toner and paper dust remaining on the photosensitive drum 51 after the transfer are collected by the cleaner 56 provided at the downstream end of a transfer position Z.

The intermediate transfer drum 61 is composed of a stainless drum 61*a* coated with a 150 $\mu$m-thick releasing layer 61*b* made of silicone rubber. The toner image is transferred onto the intermediate transfer drum 61 by electrically charging the surface of the releasing layer 61*b* by means of the corona charger 55 to make a potential difference from the photosensitive drum 51.

As previously mentioned, the pressing roller 64 for pressing against the intermediate transfer drum 61 to fix the heat-fused toner image T onto the recording paper P upon transfer, and the cleaning roller 66 for cleaning the residual toner on the intermediate transfer drum 61 are provided on the outer circumferential surface of the intermediate transfer drum 61. The pressing roller 64 and cleaning roller 66 are of the same arrangements as the aforementioned pressing roller 24 and cleaning roller 26, respectively.

To be more specific, the pressing roller 64 is composed of an aluminum column 64*a* having a diameter of 30 mm and a thickness of 5 mm and coated with a 10 $\mu$m-thick releasing layer 64*b* made of fluoride resin (polytetrafluoroethylene or PTFE for short). The cleaning roller 66 is composed of an aluminum column 66*a* having a diameter of 16 mm with a 2 mm-thick felt 66*b* made of Nomex of Dupont being wound around in spiral.

The pressing roller 64 is provided to either touch or keep a space with respect to the intermediate transfer drum 61 as the case may be. To be more specific, the pressing roller 64 moves to press against the intermediate transfer drum 61 when fixing the toner image T onto the recording paper P upon transfer, and moves to keep a space from the intermediate transfer drum 61 otherwise.

Likewise, the cleaning roller 66 is provided to either touch or keep a space with resect to the intermediate transfer drum 61 as the case may be. To be more specific, the cleaning roller 66 moves to keep a space from the intermediate transfer drum 61 until the toner image T has been transferred onto the recording sheet P, and moves to press against the intermediate transfer drum 61 after the transfer is completed.

A coil 62 for heating the intermediate transfer drum 61 by means of electromagnetic induction is provided inside the intermediate transfer drum 61 at the upstream end of its rotating direction. Also, a power source 67 for supplying power to the coil 62 is provided inside the intermediate transfer drum 61.

The power source 67 is controlled by unillustrated control means in such a manner not to pass the current to the coil 62 while the toner images in their respective colors are being transferred from the photosensitive drum 51 to the intermediate transfer drum 61, and start to pass the current to the coil 62 when the above transferring step is completed.

Thus, the coil 62 is provided at the upstream end of the pressing section of the intermediate transfer drum 61 and pressing roller 64, that is, the fixing nip section Y (fixing nip length: 4.5 mm), and the current is allowed to pass when the power source 67 is turned ON, whereby the heating section X (heating length: 23.5 mm) is formed on the stainless intermediate transfer drum 61 by means of the electromagnetic induction heating.

The coil 62 is fixed to a predetermined position in the interior of the stainless (metallic) drum 61*a,* which is determined by taking the heating conditions, such as heating efficiency, into consideration.

Next, the operation of the above-arranged color laser printer will be explained with reference to FIG. 9.

To begin with, the photosensitive drum 51 is electrically charged uniformly on the surface by the charging roller 52 as it rotates in a direction indicated by an arrow, and an electrostatic latent image is formed thereon by a laser beam irradiated from the laser irradiating device 53, which is developed into a visible image by the developing device 54.

Next, at the transfer position Z, the toner image formed on the photosensitive drum 51 is transferred onto the intermediate transfer drum 61 which is electrically charged uniformly to a polarity opposite to the polarity of the toner by the corona charger 55.

The aforementioned transferring step is carried out repetitively for each color. The pressing roller 64 and cleaning roller 66 keep a space from the intermediate transfer drum 61 and no current is allowed to pass through the coil 62 until the transferring step is completed.

When all the toner images are transferred onto the intermediate transfer drum 61 and a multi-color toner image T is formed, that is, when the transferring step is completed, a high frequency current is passed through the coil 62 from the power source 67, whereupon the stainless (metallic) drum 61*a* is heated by means of induction heating at a portion corresponding to the heating section X. At this point, the pressing roller 64 moves to press against the intermediate transfer drum 61.

The toner image T is transported to the heating section X from the transfer position Z as the intermediate transfer drum 61 rotates, and heat-fused therein. Then, the toner image T heat-fused on the intermediate transfer drum 61 is fixed onto the recording paper P at the fixing nip section Y upon transfer.

After the toner image T is transferred onto the recording paper P from the intermediate transfer drum 61, the cleaning roller 66 is pressed against the intermediate transfer drum 61 to remove the residual toner and paper dust adhering thereon.

As has been explained, in the case that the intermediate transfer drum 61 is used as the image carrying body, the heating section X is separated from the fixing nip section Y, which is a fixing section with the recording paper P, like in Embodiments 1 and 2 above where the intermediate transfer belt 21 is used as the image carrying body. Consequently, a far longer heating length than the fixing nip section Y can be readily realized, and the processing rate can be increased compared with the conventional color image forming apparatus which fixes the toner image onto the recording paper P upon heat-fusing.

In the case that the intermediate transfer drum 61 is used as the image carrying body like in the present embodiment, the fixing roller 23, which is indispensable for the intermediate transfer belt 21, can be omitted. Consequently, it has become possible to prevent a drop in temperature of the toner caused when the heat of the toner image T fused at the heating section X is conveyed to the fixing roller 23 at the upstream end of the fixing nip section Y, thereby allowing more flexible arrangement for the image forming apparatus.

A color image forming apparatus of the present invention may be arranged to comprise:

an image carrying body supported in such a manner that a toner image forming surface thereof is allowed to circulate;

image forming means for forming a multi-color toner image on the image carrying body by sequentially superimposing toner images in respective colors;

heating means for heat-fusing the multi-color image on the image carrying body; and pressing means for pressing the image carrying body from the toner image forming surface side after the multi-color toner image is transferred onto the image carrying body, wherein:

the multi-color toner image heat-fused is fixed upon transfer onto a recording material transported to a pressing position of the pressing means against the image carrying body; and the pressing position of the pressing means against the image carrying body is provided at a downstream end of a heating position where the multi-toner image is heated by the heating means along a circulation direction of the image carrying body.

The color image forming apparatus may be further arranged in such a manner that, let T1 be a temperature at an interface between toner and the recording material when the toner image is fixed onto the recording material upon transfer, and T2 be a temperature of the toner when viscosity of the toner is set to a value such that can realize satisfactory fixing strength, then the toner images and the image carrying body are pre-heated by the heating means to satisfy: $T1 \geqq T2$.

Accordingly, the toner image and image carrying body are heated by the heating means in such a manner that the temperature T1 at the interface between the toner and recording material when the toner image is fixed onto the recording material upon transfer becomes as high as or above the temperature T2. Thus, the temperature at the interface between the toner and recording material can be raised to a temperature at which satisfactory fixing strength can be secured. Hence, the fixing properties are not affected adversely by a temperature of the recording material transported to the pressing section between the image carrying body and pressing means. Consequently, it has become possible to prevent fixing deficiency that occurred when the recording material transported to the pressing position of the pressing means against the image carrying body is too cold (absorbs too much heat).

The color image forming apparatus may be further arranged in such a manner that the temperature at the interface between the toner and recording material is found from logical computation using temperatures of the toner right before being fixed upon transfer onto the recording material, image carrying body, pressing means, and recording material.

Accordingly, although an actual temperature at the interface between the toner and recording material can not be measured easily, the temperature at the interface between the toner and recording material can be found from the logical computation using the temperatures actually measured.

The color image forming apparatus may be further arranged in such a manner that, let T3 be a softening point temperature of the toner and T4 be a temperature of the toner right before the toner image is fixed onto the recording material upon transfer, then, before fixing the toner image onto the recording material upon transfer, the toner image and image carrying body are heated by the heating means to satisfy: $T4-T3 \geqq 60(°\ C.)$.

Accordingly, the toner image and image carrying body are heated in such a manner that there is a difference of 60° C. or more between the temperature T4 of the toner right before the toner image is fixed onto the recording material upon transfer and the temperature T3 of the toner softening point, and therefore, a temperature at the interface between the toner and recording material is raised sufficiently high to secure the satisfactory fixing strength. Thus, the fixing properties are not affected adversely by a temperature of the recording material transported to the pressing section of the pressing means against the image carrying body. Consequently, it has become possible to prevent fixing deficiency that occurred when the recording material transported to the pressing position of the pressing means against the image carrying body is too cold.

The color image forming apparatus may be further arranged in such a manner that the image carrying body is an endless image carrying belt bridged across at least two rollers, and that the heating means is provided in such a manner to oppose an inner circumferential surface of the image carrying belt.

Accordingly, since the image carrying body is a belt and the heating means is provided on the inner side of the image carrying belt, heat is conveyed from the inner side to the outer side (toner image forming surface) of the image carrying belt. Moreover, if the heating means is formed long along the circulation direction (moving direction) of the image carrying belt to conform to the shape of the belt, a length of the heating section for heat-fusing the toner can be readily extended. Also, if the heating means also serves as one of the rollers forming belt bridging means, the arrangement can be simplified.

Consequently, the heating section can be designed more flexibly in such a manner to heat a multi-color toner image uniformly regardless of the layer thickness, thereby allowing more flexible design for the apparatus.

The color image forming apparatus may be further arranged in such a manner that the heating means is a heating roller, which is one of the rollers across which the image carrying belt is bridged, and positioned at an upstream end of the pressing position of the pressing means against the image carrying belt.

Consequently, since the image carrying belt is bridged across the heating roller, the surface of the image carrying belt at a portion that touches the heating roller serves as the heating section. In other words, since a portion of the image carrying belt wound around the heating roller serves as the heating section, a length of the heating section can be readily adjusted by changing a diameter of the heating roller or a contact angle of the image carrying belt with respect to the heating roller. Further, the apparatus can be designed in a more flexible manner.

It is preferable that a heater lamp is provided inside the heating roller.

Since the heater lamp is provided inside the heating roller, the heating action by the heating roller with respect to the heating section can be readily controlled by merely controlling the ON/OFF action of the heater lamp.

The color image forming apparatus may be further arranged in such a manner that the heating means is provided somewhere between the pressing position and one of the two rollers across which the image carrying belt is bridged, so that the inner circumferential surface of the image carrying belt slides along the heating means.

Accordingly, since the heating means is provided somewhere between the pressing position and one of the two rollers across which the image carrying belt is bridged to let the inner circumferential surface of the image carrying belt slide along the heating means, the heating means can be provided more closely to the pressing position compared with a case where the heating roller, across which the image carrying belt is bridged, is used as the heating means.

Consequently, a distance between the heating section to the pressing position can be shortened, and a drop in temperature of the heat-fused toner can be minimized, thereby eliminating fixing deficiency caused by a drop in temperature of the toner image. Thus, the above arrangement can realize more stable fixing properties compared with a case where the heating roller, across which the image carrying belt is bridged, is used as the heating means.

It is preferable that the heating means is a thermal heater having a planar heating body which can heat up quickly.

When the heating means is a thermal heater having a planar heating body which can heat up quickly, the heating section can be heated up promptly. Also, since the thermal heater is planar, it can be provided closely to the fixing nip section, thereby making it possible to minimize a drop in temperature of the toner while it is transported from the heating section to the fixing nip section. Consequently, a temperature of the fused toner at the fixing nip section can be controlled readily and the fused toner can be fixed onto the recording material in a stable manner.

The image carrying body may be an image carrying drum, and the heating means may be provided inside the image carrying drum.

When the image carrying body is an image carrying drum and the heating means is provided inside the image carrying drum, the pressing means forms a pressing section (fixing nip section) by pressing against a toner image forming surface of the image carrying drum. In other words, in the case that a roller is used as the pressing means when the image carrying body is a drum, one roller is sufficient.

By contrast, the image carrying belt forms the pressing section (fixing nip section) by sandwiching the image carrying belt from both the inner and outer circumferential surfaces sides. In other words, in the case that a roller is used as the pressing means when the image carrying body is a belt, at least two rollers are necessary at the inner and outer circumferential surfaces sides of the image carrying belt, respectively.

Thus, when the image carrying belt is used as the image carrying body, heat may be conveyed from the toner to the roller forming the fixing nip section, thereby possibly causing a drop in temperature of the toner and hence fixing deficiency.

By contrast, when the image carrying drum is used as the image carrying body, since only one roller is used, a quantity of heat conveyed from the toner to the roller is quite small. Consequently, the apparatus can be designed without worrying about how much heat will be conveyed from the toner to the pressing means, and the apparatus can be designed in a more flexible manner.

The color image forming apparatus may be further arranged in such a manner that the image carrying drum has a metallic drum and the heating means is a coil which heats the metallic drum by means of induction heating.

When the heating means is the coil that heats the metallic drum inside the image carrying drum by means of induction heating, the coil can heat the metallic drum without touching the same. Consequently, the coil can be provided fixedly to a position inside the image carrying drum which is allowed to rotate.

In addition, since the coil heats up and starts to heat the metallic drum to a predetermined temperature by means of induction heating as soon as the current is passed, the warm-up period can be cut shorter.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image; and when Cb is a heat capacity of said image carrying body and Cr is a heat capacity of said pressing means, then $Cr>30\times Cb$.

2. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image; and when $L_1$ is a heating length of said heating means in a circulation direction of said image carrying body at the heating position, and $L_2$ is a pressing length of said image carrying body against the recording material in the circulation direction thereof at the pressing position, then said heating means is set to satisfy:

$L_2 \times 10 > L_1 > L_2 \times 2$.

3. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image; and said pressing means includes a fixing roller and a pressing roller, said fixing roller being composed of a metallic column whose surface is coated with foam silicone rubber, said pressing roller being composed of a metallic drum whose surface is coated with fluoride resin.

4. The color image forming apparatus of claim 3, wherein said pressing roller is of a heat pipe structure having a heat absorbing section and a heat releasing section inside said metallic drum.

5. The color image forming apparatus of claim 3, wherein said fluoride resin is polytetrafluoroethylene.

6. The color image forming apparatus of claim 3, wherein;

said image carrying body is an endless belt; and said heating means is provided in such a manner to reduce a contact angle of at least one of said fixing roller and pressing roller with respect to said image carrying body.

7. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image;

said image carrying body has an image carrying belt bridged across at least two rollers;

said heating means is provided at an end of an inner circumferential surface of said image carrying belt; and said heating means is provided between the pressing position and one of said at least two rollers across which said image carrying belt is bridged in such a manner as to slide along the inner circumferential surface of said image carrying belt.

8. The color image forming apparatus of claim 7, wherein said heating means includes a thermal heater having a planar heating body which can heat up immediately upon electrical conduction.

9. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image;

said image carrying body has an image carrying belt bridged across at least two rollers;

said heating means is provided at an end of an inner circumferential surface of said image carrying belt; and said heating means is a heating roller, said heating roller being one of said rollers across which said image carrying belt is bridged and provided at an upstream end of said pressing position of said pressing means against said image carrying belt.

10. The color image forming apparatus of claim 9, wherein a heater lamp is provided inside said heating roller.

11. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image; and when T1 is a temperature of an interface between toner and the recording material when the toner image is fixed onto the recording material upon transfer, and T2 is a temperature of the toner when viscosity of the toner is set to a value that can attain sufficient fixing strength, said heating means heats the toner image and said image carrying body to satisfy: T1>>T2.

12. The color image forming apparatus of claim 11, wherein the temperature of the interface between the toner and the recording material is computed by a logical computation using temperatures of the toner right before being fixed onto the recording material upon transfer, said image carrying body, said pressing means, and the recording material, as well as materials from which the toner, said image carrying body, said pressing means, and the recording material are made.

13. A color image forming apparatus comprising:

an image carrying body supported in such a manner that a toner image forming surface thereof is allowed to circulate;

image forming means for forming a multi-color toner image on said image carrying body by sequentially superimposing toner images in respective colors;

heating means for heat-fusing the multi-color toner image on said image carrying body; and pressing means for pressing said image carrying body from the toner image surface side, wherein:

the multi-color toner image heat-fused is fixed upon transfer onto a recording material transported to a pressing position of said pressing means against said image carrying body;

the pressing position of said pressing means against said image carrying body is provided spaced apart from a heating position at which said heating means heat-fuses the multi-color toner image; and when T3 is a softening point temperature of toner and T4 is a temperature of the toner right before the toner image is fixed onto the recording material upon transfer, then said heating means heats the toner image and said image carrying body to satisfy: T4−T3>>60° (C.).

* * * * *